US005512025A

United States Patent [19]

Dalebout et al.

[11] Patent Number: 5,512,025

[45] **Date of Patent: * Apr. 30, 1996**

[54] USER-PROGRAMMABLE COMPUTERIZED CONSOLE FOR EXERCISE MACHINES

[75] Inventors: William T. Dalebout; Donald J. Standing, both of Logan; Scott R. Watterson, River Heights; Dane P. Brewer, Salt Lake City; Lee Robertson, Sandy; David R. Rowley, Kearns, all of Utah

[73] Assignee: ICON Health & Fitness, Inc., Logan, Utah

[ * ] Notice: The portion of the term of this patent subsequent to Nov. 26, 2008, has been disclaimed.

[21] Appl. No.: 724,732

[22] Filed: Jul. 2, 1991

Related U.S. Application Data

[63] Continuation-in-part of Ser. No. 455,631, Dec. 22, 1989, Pat. No. 5,062,632, Ser. No. 667,034, Mar. 11, 1991, abandoned, and Ser. No. 415,160, Sep. 29, 1989, Pat. No. 5,067,710, which is a continuation-in-part of Ser. No. 306, 872, Feb. 3, 1989, Pat. No. 4,998,725, said Ser. No. 667,034, is a continuation of Ser. No. 306,872 Pat No. 4,998,725.

[51] Int. Cl.[6] ..... A63B 21/005

[52] U.S. Cl. ..... 482/6; 482/54; 482/57; 482/902; 482/903; 73/379.01; 601/23

[58] Field of Search ..... 482/1, 4–8, 52–54, 482/57, 900–903; 128/25 R, 25 B; 364/410; 73/379, 379.01, 379.06, 379.07; 601/23

[56] References Cited

U.S. PATENT DOCUMENTS

| | | | |
|---|---|---|---|
| 3,518,985 | 7/1970 | Quinton . | |
| 3,744,480 | 7/1973 | Gause et al. . | |
| 3,744,794 | 7/1973 | Gause et al. . | |
| 3,859,840 | 1/1975 | Gause . | |
| 4,323,237 | 4/1982 | Jungerwirth . | |
| 4,358,105 | 11/1982 | Sweeney, Jr. | 482/902 X |
| 4,378,111 | 3/1983 | Tsuchida et al. . | |
| 4,504,968 | 3/1985 | Kaneko et al. . | |
| 4,519,603 | 5/1985 | DeCloux . | |
| 4,566,461 | 1/1986 | Lubell et al. | 482/8 X |
| 4,708,337 | 11/1987 | Shyu | 482/900 X |
| 4,708,338 | 11/1987 | Potts | 482/902 X |
| 4,714,244 | 12/1987 | Kolomayets et al. . | |
| 4,842,266 | 6/1989 | Sweeney, Sr. et al. . | |
| 4,869,497 | 9/1989 | Stewart et al. . | |
| 4,938,474 | 7/1990 | Sweeney et al. | 482/902 X |
| 4,976,424 | 12/1990 | Sargeant et al. . | |
| 4,998,725 | 3/1991 | Watterson et al. . | |
| 5,020,794 | 6/1991 | Englehardt et al. | 482/902 X |
| 5,062,632 | 11/1991 | Dalebout et al. . | |
| 5,067,710 | 11/1991 | Watterson et al. . | |

OTHER PUBLICATIONS

NASA Disclosure of Invention Case No. MFS–21109 by Gause, Sep. 22, 1970, for Multi–Mode Ergometer.

Color photographs (labeled 1–3) from Skylab display at Smithsonian Air and Space Museum.

Photocopies of brochure pages (labeled A–E) depicting exercise device (1989).

(List continued on next page.)

*Primary Examiner*—Richard J. Apley
*Assistant Examiner*—Joe H. Cheng
*Attorney, Agent, or Firm*—Trask, Britt & Rossa

[57] ABSTRACT

A control console for exercise machines such as treadmills having a microprocessor to generate signals to control the exercise. The console is operable to control an exercise program comprising a series of time segments for which the difficulty levels are individually specified, and to provide a display of the program time segments. The console is further operable to display and store user-designed programs of the type described. Optionally, the console is operable to control two difficulty parameters of an exercise machine. The console may also include preset programs selectable by a user. The preset programs may include a fitness test comprising a series of exercise time segments of increasing difficulty, in which a user's fitness level is based on the user's inability to continue exercising beyond a particular time segment.

25 Claims, 27 Drawing Sheets

OTHER PUBLICATIONS

Electronic Solutions Inc. Model 402 Cardiac Stress Control Operator's Manual and Maintenance Manual–Revision 3, dated Nov. 12, 1983 (RM06467–06479).
Electronic Solutions Inc. Biocycle Controller Technical Manual–Revision 2, Dated Feb. 10, 1984) (RM06480–06497).
Lifestyler 3100ps Programmable Speed Treadmill Owner's Manual, Oct. 1989.
Proform Equalizer 10.0si Programmable Speed/Incline treadmill Owner's Manual, Oct. 1989.
Roadmaster's Vitamaster Forerunner Model 9899 Owner's Manual, 1991.
Electronic Monitor Operation Guide, 1991.
Proform T90 Programmable Pulse Ergometer Owner's Manual, 1989.
Proform C90 Programmable Pulse Ergometer Owner's Manual, Dec. 1988.
Ad slick for the Proform T90, 1989.
T70 Treadmill ad slick from Proform, 1987.
Ad slick for T90 Treadmill, 1988.
Ad slick for C70 cycle by Proform, 1988.
Ad slick for the C90 Programmable cycle, 1988.
Ad slick for C90 Programmable Pulse Ergometer, 1989.
NASA Tech Brief dated May 1971.
"Exercise and Long Duration Spaceflight through 84 Days" by Runnel et al, JAMWA–vol. 30, No. 4, Apr. 1975, pp. 173, 176–179, 181, 182 and 184–187.
*Skylab Experiments,* Aug. 1972 p. 1–4 and 55–59.
*Skylab, A Chronology, 1977 by Newkik et al, pp. 280–282, 298–300, 366 and 367.*
*Living and Working in Space; A History of Skylab,* 1983 by Compton et al. pp. 149–152, 226, 227, 284, 286 and 287.
Avita News, Oct. 1986, published by M & R Industries, pp. 1 and 10–12.
Quinton catalog, 1974.
Quinton "Model 642 Program Control Instruction Manual", May , 1970, pp. 1–5.
Quinton "Model 644 Programmer Service Manual", 1979, pp. 1.1–3.10.
Quinton "Model 644 Programmer Operator Manual", pp. 1.1–4.3.
Quinton "Model 645 Programmable Treadmill Controller Operator/Service Manual" 1983, pp. 1.1–4.10.
Quinton Treadmills "Built to Endure" Catalog, May 1987.
Brochure "DP Tach 3 Exercise Bike User's Manual", 1985, pp. 1–36.
Brochure for Percor M9.4/9.4sp and M9.5/9.5sp 1989.
Story in Mar. 5, 1989 Los Angeles Times, News Exercise Devices Do it All, Including a Fast Physical Examin by La Ganga, pp. 1–3.
Two–page brochure for Velodyne dated Dec. 1988.

| STAGE | TIME (MIN.) | (MPH) SPEED | ANGLE OF INCLINE | FITNESS RATING |
|---|---|---|---|---|
| 1 | 1.25 | 1.0 | .75 | 1 |
| 2 | 1.0 | 2.0 | 1.5 | 2 |
| 3 | 1.0 | 2.6 | 2.5 | 3 |
| 4 | 1.0 | 3.25 | 3.5 | 4 |
| 5 | 1.0 | 3.87 | 4.75 | 5 |
| 6 | 1.0 | 4.5 | 6.0 | 6 |
| 7 | 1.0 | 5.25 | 6.75 | 7 |
| 8 | 1.0 | 6.0 | 7.5 | 8 |
| 9 | 1.0 | 6.5 | 8.75 | 9 |
| 10 | 1.0 | 7.0 | 10.0 | 10 |

Fig. 16

USER-PROGRAMMABLE COMPUTERIZED CONSOLE FOR EXERCISE MACHINES

RELATED APPLICATIONS

This application is a continuation-in-part of application Ser. No. 07/667,034 filed Mar. 11, 1991 (now abandoned), which application is a continuation of Ser. No. 07/306,872, filed Feb. 3, 1989, now U.S. Pat. No. 4,998,725. This application is also a continuation-in-part of application Ser. No. 07/415,160, filed Sep. 29, 1989 now U.S. Pat. No. 5,067,710, which is also a continuation-in-part of application Ser. No. 07/306,872, now U.S. Pat. No. 4,998,725. This application is furthermore a continuation-in-part of Ser. No. 07/455,631 filed Dec. 22, 1989, now U.S. Pat. No. 5,062, 632.

BACKGROUND OF THE INVENTION

1. Field

This invention is related to devices for controlling exercise machines and more particularly controls for regulating the difficulty and duration of exercise by the user.

2. State of the Art

It is generally accepted that an exercise program undertaken at regular or repetitive intervals (e.g., three times per week) is a preferred format to secure the best results from the exercise. In order to undertake such a program, it is desirable to perform a set or a sequence (e.g., 5 to ten) of different but complementary exercises each for a selected period (e.g., 10 to 30 minutes each) at the regular or repetitive intervals. Over time, each of the set or sequence of exercises is performed for an increasingly longer time period or with an increased degree of difficulty for substantially the same time period. To make it easy for an average user to keep up a regular exercise routine, it is particularly desirable to have an exercise machine which is simple, inexpensive and lightweight enough for home use.

Individuals vary in their exercise needs and desires. Therefore, it is desirable to provide home exercise machines with a console or control system which is operable by a user to easily design her or his own exercise program, and to store that program for future use. By performing sets or sequences of similar exercises for the same or similar time periods (e.g., ten to 30 minutes) at regular intervals (e.g., three times per week) over an extended time period (e.g., six months), a user can note his or her own increased capability to perform the exercises. Moreover, it is desirable for the user to be able to modify the involved exercise program, or to provide for one or more user-designed programs, all to make the overall exercise easier or more difficult or to otherwise adapt the program to the needs or desires of the users. Further, a mixture of exercise programs can enhance the effectiveness of the exercise by providing for a regulated increase in the time or difficulty and also eliminate some of the monotony attributable to some programs. Such a console or control system would preferably be very "user-friendly", i.e., simple to program with a simple display depicting the programmed exercise.

It is further desirable that an exercise machine console or control system, in addition to being user-programmable, be able to provide preset or "canned" programs. Such preset programs could be fitness tests or workouts predesigned to achieve certain exercise performance goals or the like.

Certain previous exercise machine controllers, such as those described in U.S. Pat. No. 4,678,182 (Nakao), U.S. Pat. No. 4,708,337 (Shyu), and EP 0 199 442 to Tsuyama, have not provided a user-programming mode, but have not provided a user-programming option. Instead, these consoles provide only manual operation, a choice of factory-inserted programs, or both. Without user programming, the user must remember or record externally the duration and difficulty of the exercise, if a user desires to repeat a user designed exercise sequence. Alternatively, the user may be forced to select a preset program, which may not fit the user's particular needs or desires.

A treadmill is one type of exercise machine which is widely available and may include a variety of features and operational controls. Typical treadmills include controls to vary the speed of the tread as well as some type of structure to vary the angle of inclination of the treadmill surface. Adjustments to the angle of inclination may be made in order to regulate what may be viewed as the resistance or the degree of difficulty of the exercise being performed by the user on the treadmill. Desirably, such a machine would have user programmable features.

Another type of exercise machine for which a user programmable console is desirable is a stepper or climber. For such a machine, the exercise difficulty parameter is the effort required to step up and thereby push the pedal to the low position, and the speed of stepping.

A need remains for an improved user-programmable computerized console to control exercise machines including treadmills and steppers or climbers. Desirably, such a console would allow a user to simply and easily program a series of time segments in terms of exercise parameters including speed and difficulty or effort required per exercise movement. Desirably also, the console would additionally provide a manual mode and/or preset programs.

SUMMARY OF THE INVENTION

A computerized control console is provided for use with an exercise apparatus of the type which has a frame with a movable element for a user to perform exercise movements and difficulty adjustment means operably adapted to the movable element for adjusting the difficulty of movement. The console is configured for mounting to the frame of the exercise apparatus. For a treadmill exercise machine, the console is operable to control difficulty adjustment means to adjust the speed of the treadmill and the inclination of a treadmill. For an exercise cycle, the console is operable to control the resistance to rotation of a flywheel or fan. Other exercise machines such as steppers, rowers or the like may also be similarly configured for operation by the control console.

The control console includes computation means for computing difficulty control signals to implement a desired difficulty level and operable to control said exercise machine to execute an exercise program including a timed sequence of different difficulty levels. Output means are connected to the computation means to receive and convert the difficulty control signals to output signals. The output means is also connected to supply the output signals to the difficulty control means. Input means is connected to the computation means for a user to initiate an exercise program, and is operable to select exercise parameters of said program including total exercise time and at least one difficulty level. Display means is operably associated with the input means for displaying the selected exercise parameters. The console further includes memory means connected to the input means for receiving and retaining at least one user-designed exercise program comprising a sequence of time segments for which difficulty levels of a selected exercise parameter are individually specified. The memory means is further connected to the computation means to supply data reflective of the user-designed program thereto.

In a further embodiment, the memory means also retains at least one preset program comprising a sequence of time segments each having a prescribed difficulty level. The input means is then further operable by a user to designate either a user-designed program or a preset program, each having such a sequence for execution by the computation means.

In a preferred embodiment, the display means includes a graphical display of the sequence of difficulty levels of either a user-designed program or a preset program. The graphical display comprises a plurality of columns of indicators, each column corresponding to a respective individual time segment. The indicators are ordered within the columns to correspond to difficulty levels between zero and a maximum difficulty, according to relative vertical position. Each indicator is operable between an activated and a deactivated state. An individual column represents a difficulty level specified by the program by having at least one activated indicator at a vertical position corresponding to the programmed difficulty level for that time segment. The graphical display thus provides a visual summary of a user-designed or preset program to the user. In a highly preferred embodiment, during execution of the program the display means further provides a visual progress identifier which identifies the time segment currently being executed.

BRIEF DESCRIPTION OF THE DRAWINGS

In the drawings, which illustrate what is presently regarded as the preferred embodiment:

FIG. 16 is a table containing values corresponding to different fitness levels.

DETAILED DESCRIPTION OF THE ILLUSTRATED EMBODIMENT

Figure 1:
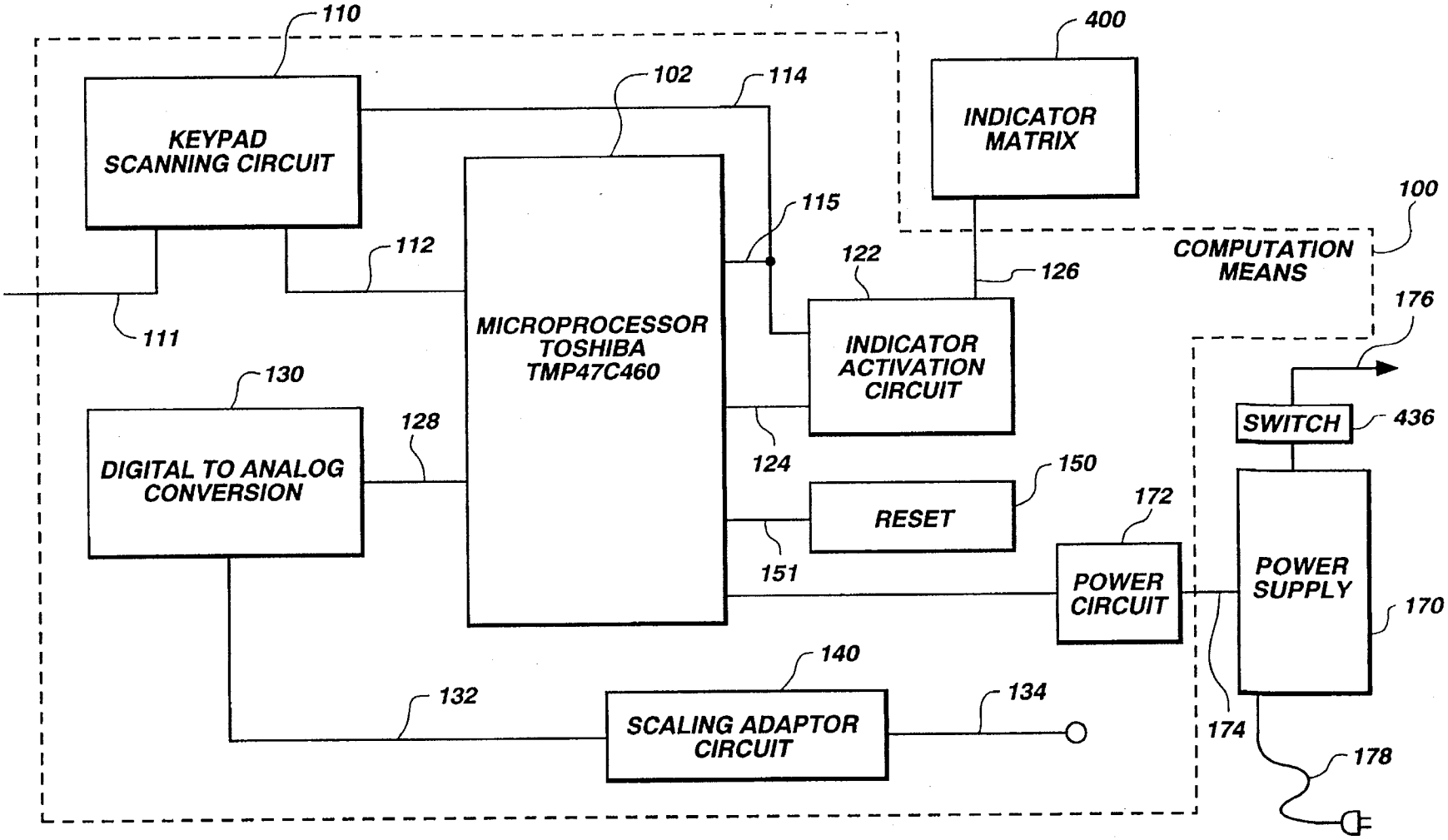
FIG. 1 is a block diagram of the control console of the instant invention.

FIG. 1 is a schematic block diagram of portions of a control console generally indicated by the numeral 10 (FIG. 3) including specifically computation means 100. Major components of this computation means 100 are indicated by different blocks as more fully described hereinafter. The control console 10 includes a chassis 12 (FIG. 1A) for adaptation to an exercise machine such as a treadmill 14 by any appropriate means such as a bracket 16 secured to the frame 18 by a bolt or screw 19 positioned through aperture 20 in the bracket 16 and a corresponding aperture in the frame 18 and secured with a nut 22. Alternate securing means may be used as desired. The computation means 100 includes a user-programmable microprocessor 102 disposed within the chassis 12 and associated with a program input and display means operable and visible respectively on the chassis surface 24. In the illustrated embodiment of FIG. 3, the program input means includes a membrane configured to supply keypad data signals to the keypad scanning circuit 110 via conductor means 111. That is, the various control keys 406, 408, 412, 430, 432, 434, 438A and 438B are configured to operate a membrane key circuit to supply the desired operating signals to the microprocessor 102. The display means includes the indicator matrix 400, the timer 410, the speedset 440 and speed indicator 439. As noted, the display means is here selected to be an array of light emitting diodes (LEDs). Other visual indication devices may be selected, including a liquid crystal display arrangement as well as low voltage bulbs. The LED array is preferred for reliability, longevity, durability as well as low cost.

As stated, the computation means 100 includes a central processing unit (CPU) 102 which is a microprocessor incorporating ROM (read-only memory), RAM (random access memory), keyboard interface (sometimes known as an encoder), display output interface and control data output interface (sometimes known as a decoder). In the illustrated embodiment, these functions are all found on a single microprocessor chip, which is a Toshiba TMP47C460. However, as known in the art, the same combination of functions may be achieved by other microprocessing chips or a variety of other chips or arrangements in which individual chips for each function are interconnected.

The keypad scanning circuit 110 of the computation means 100 receives a scanning input signal via conductor 112 from CPU 102 and supplies a scanning output signal which is read by CPU 102 via conductors 114 and 115. In FIG. 1, these and other connections to CPU 102 are shown as single conductors each of which should be understood to comprise a plurality of pin connections as known in the art of microprocessor control systems. Specific pin connections and other circuit components for a working embodiment are specified in more detail in FIGS. 2A–2F.

Figure 2A:
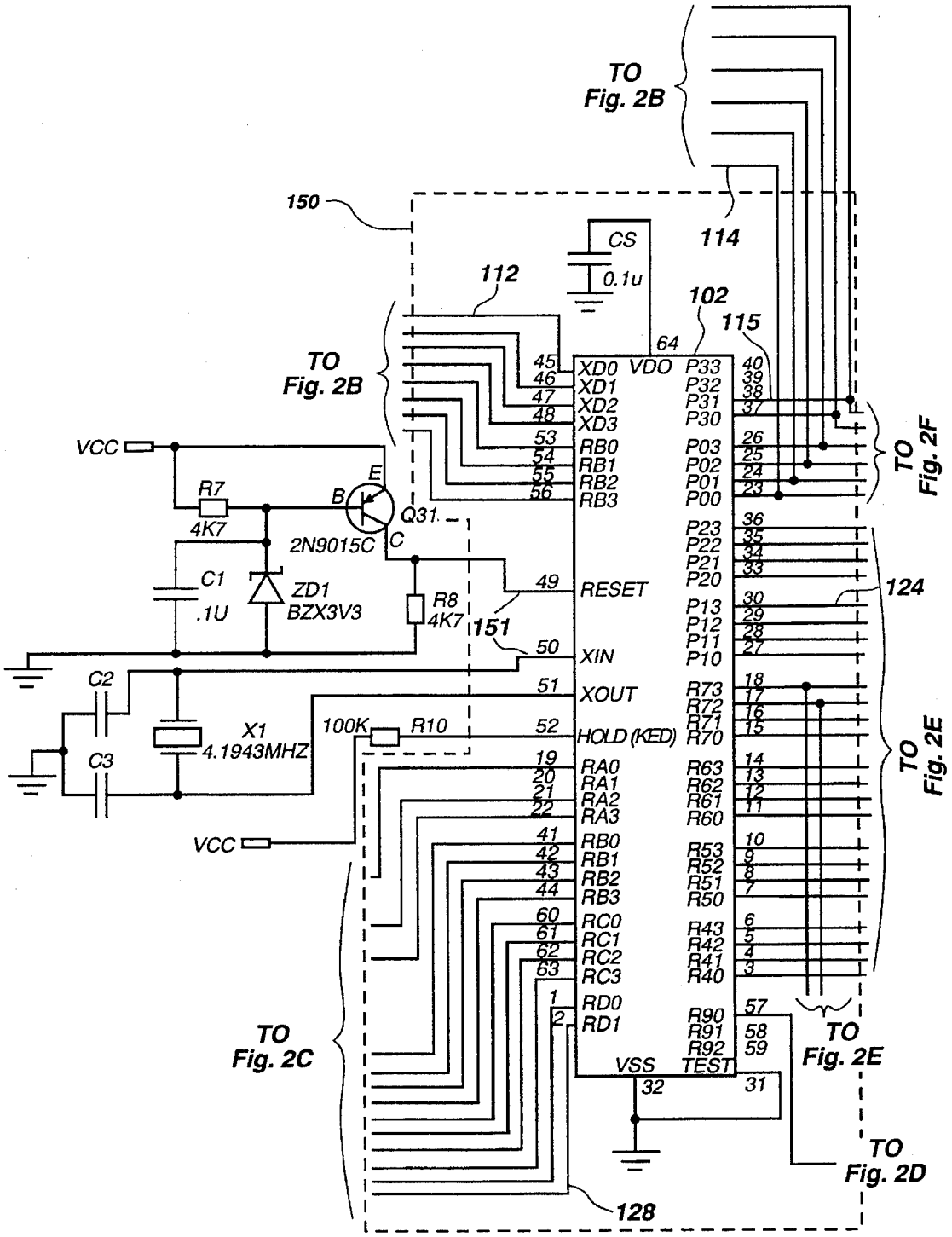
FIGS. 2A, 2B, 2C, 2D, 2E, and 2F depict specific circuits of a working embodiment of the console of FIG. 1.
Figure 2B:
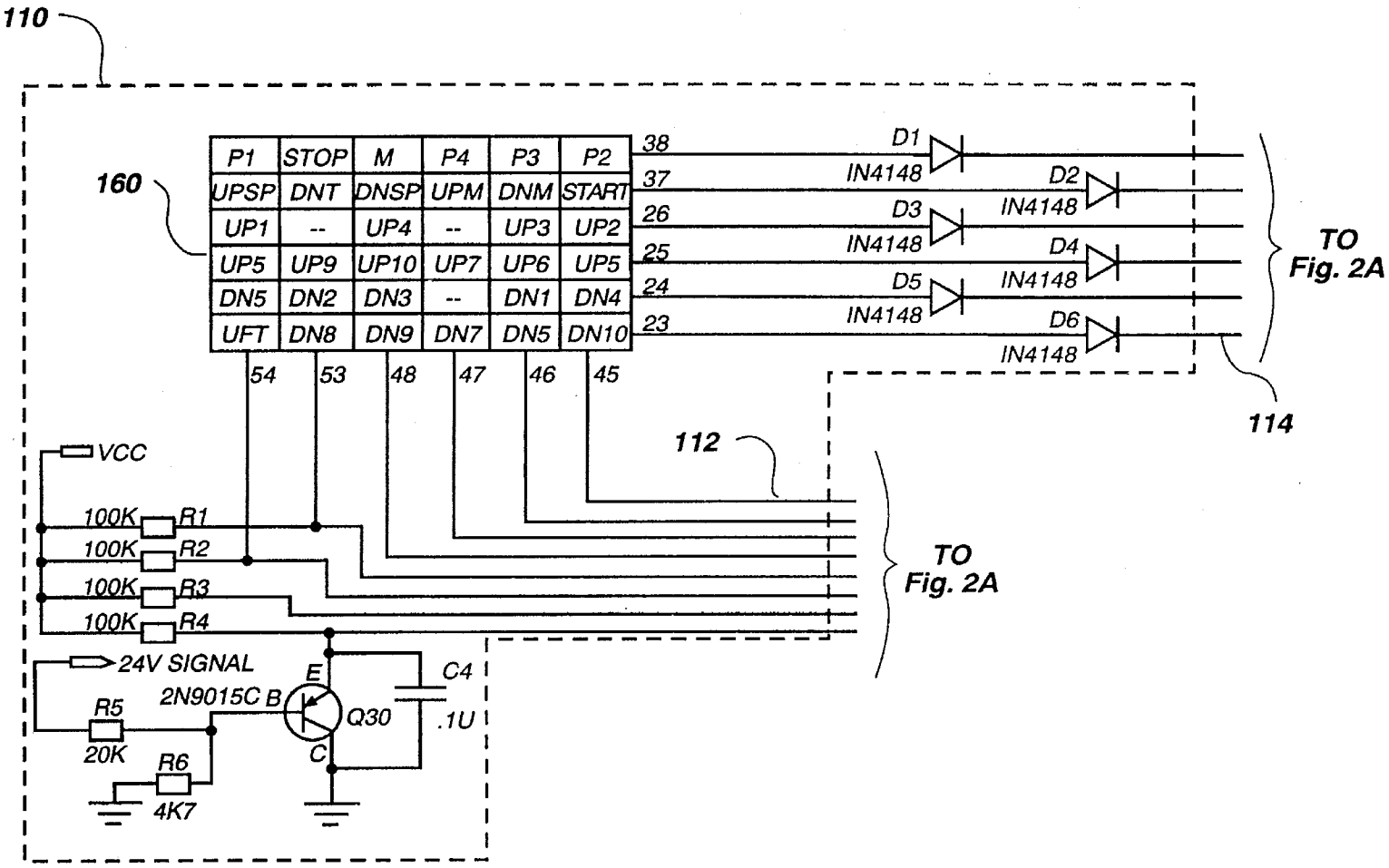
Figure 3:
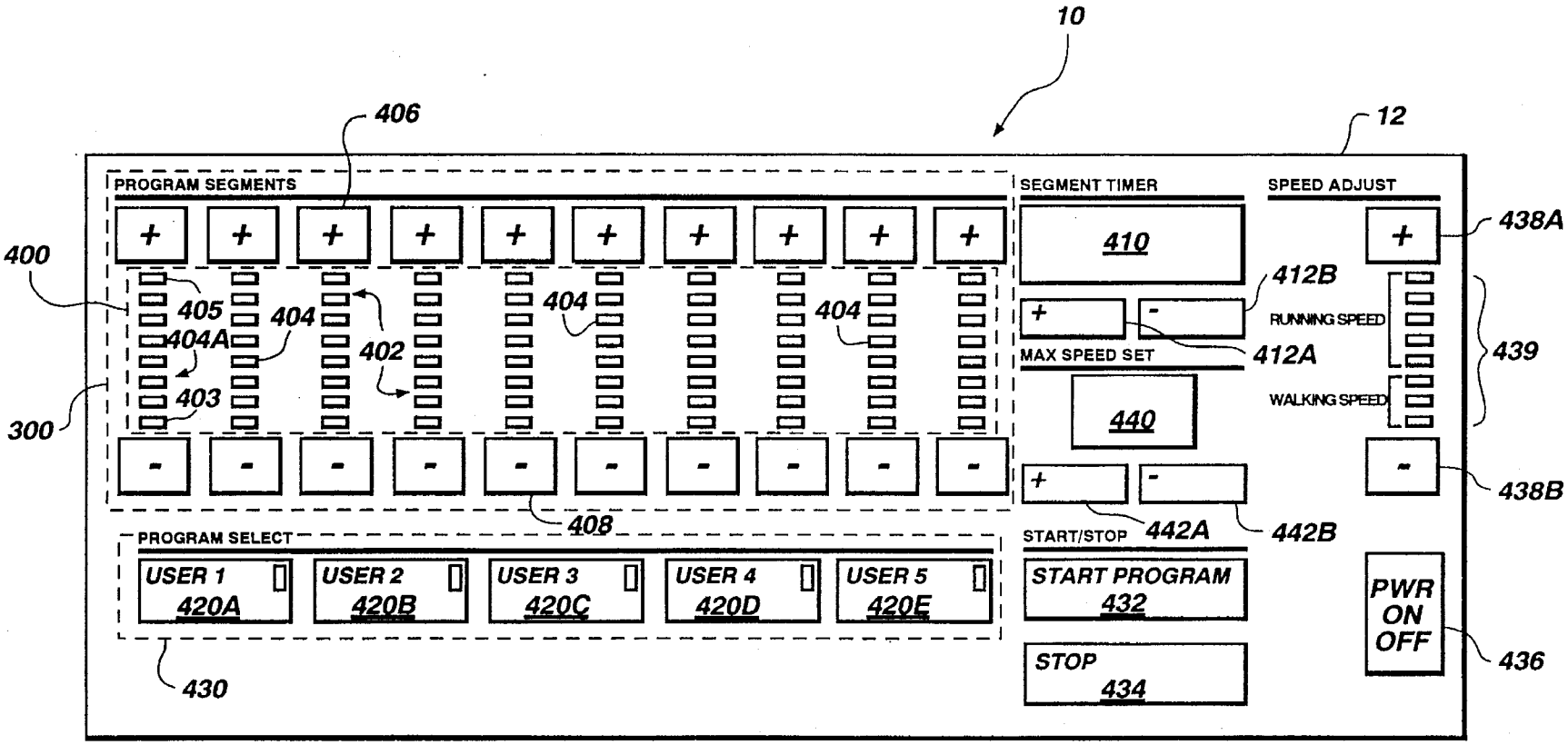
FIG. 3 is a front view of the chassis of the control console.

The keypad scanning circuit 110 of FIG. 2B has a capacity to scan 36 keys, but the embodiment of FIGS. 2B and 3 only has 33 keys. Other keypad scanning circuits may be used for keypads having more keys or fewer keys. In some configurations, multiple keypad scanning circuits may be used. Whatever arrangement is selected, it can be seen that the keypad scanning circuit functions to receive the keypad signals and buffer them for input into the CPU.

Figure 2C:
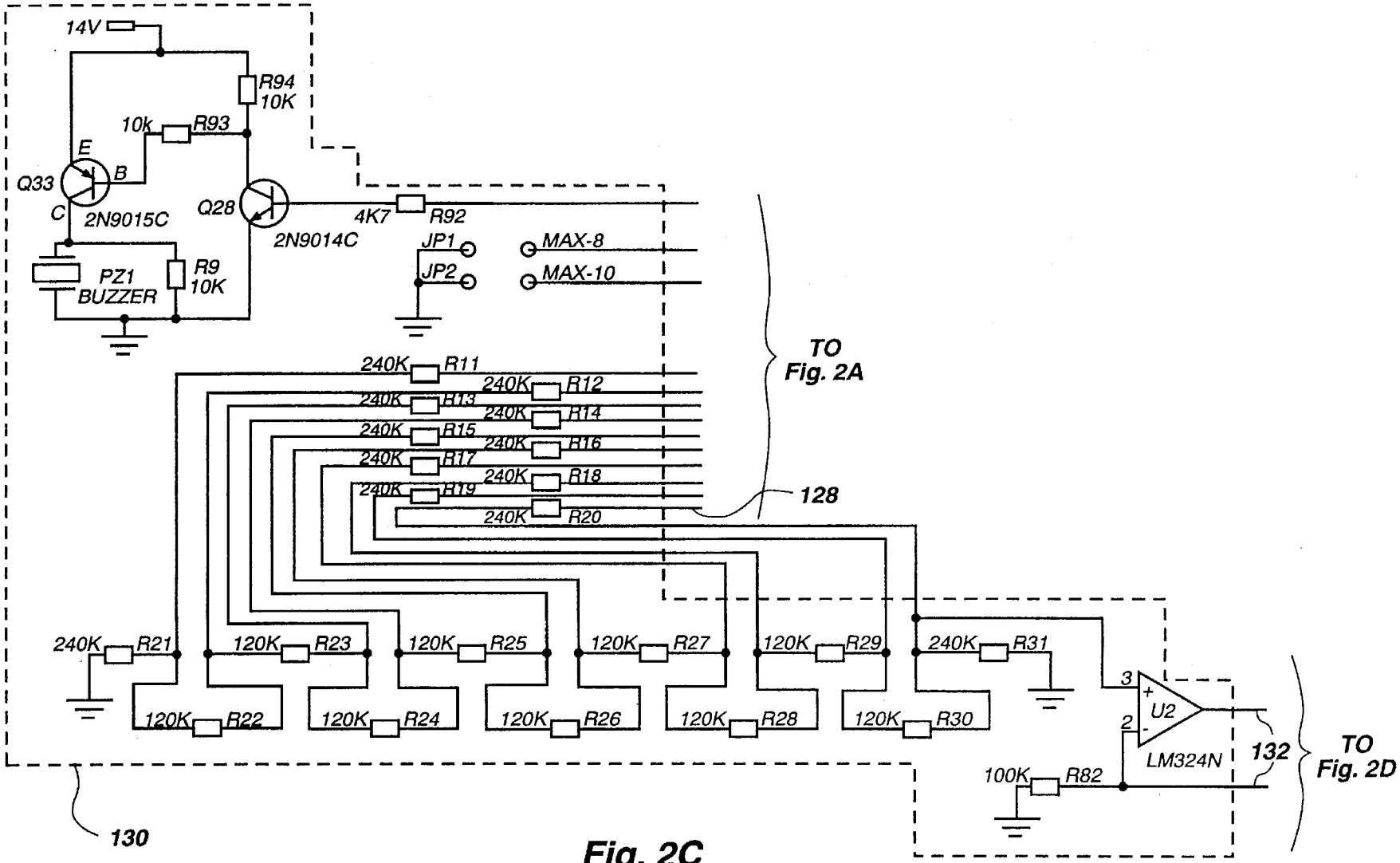
Figure 2D:
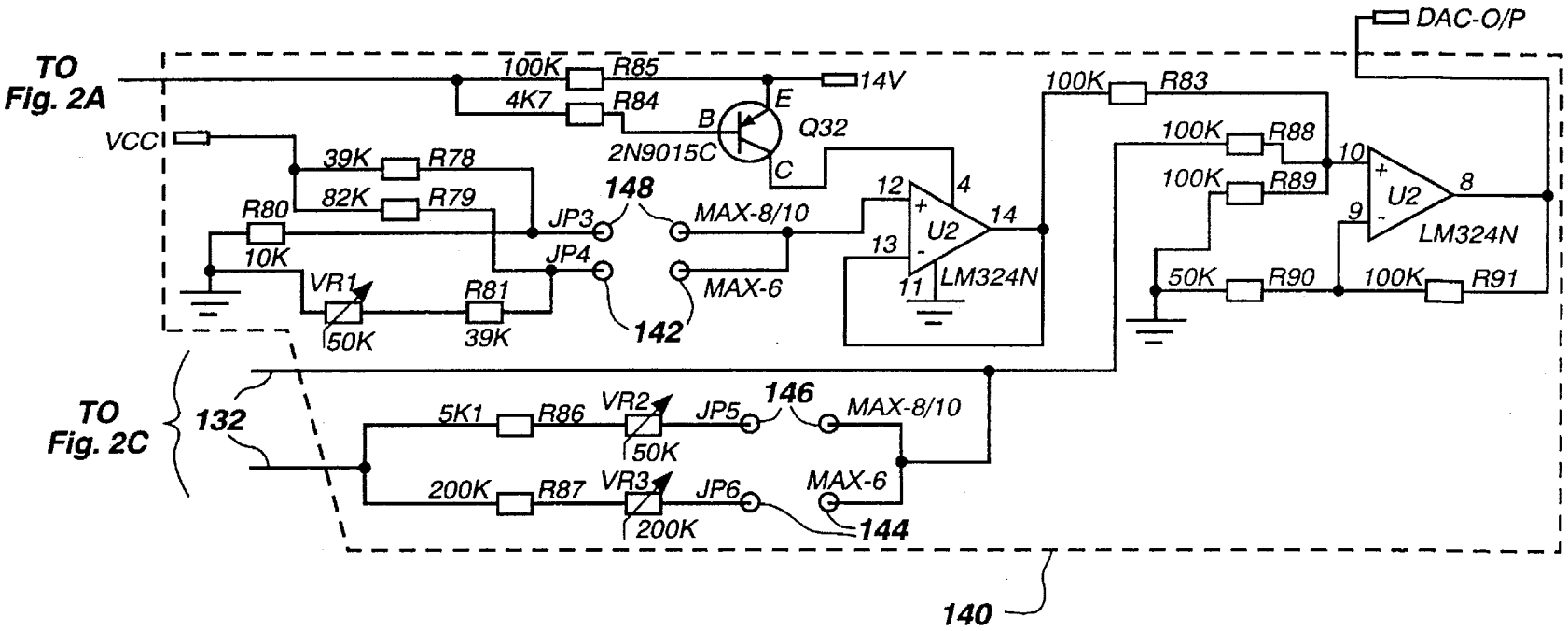
Figure 2E:
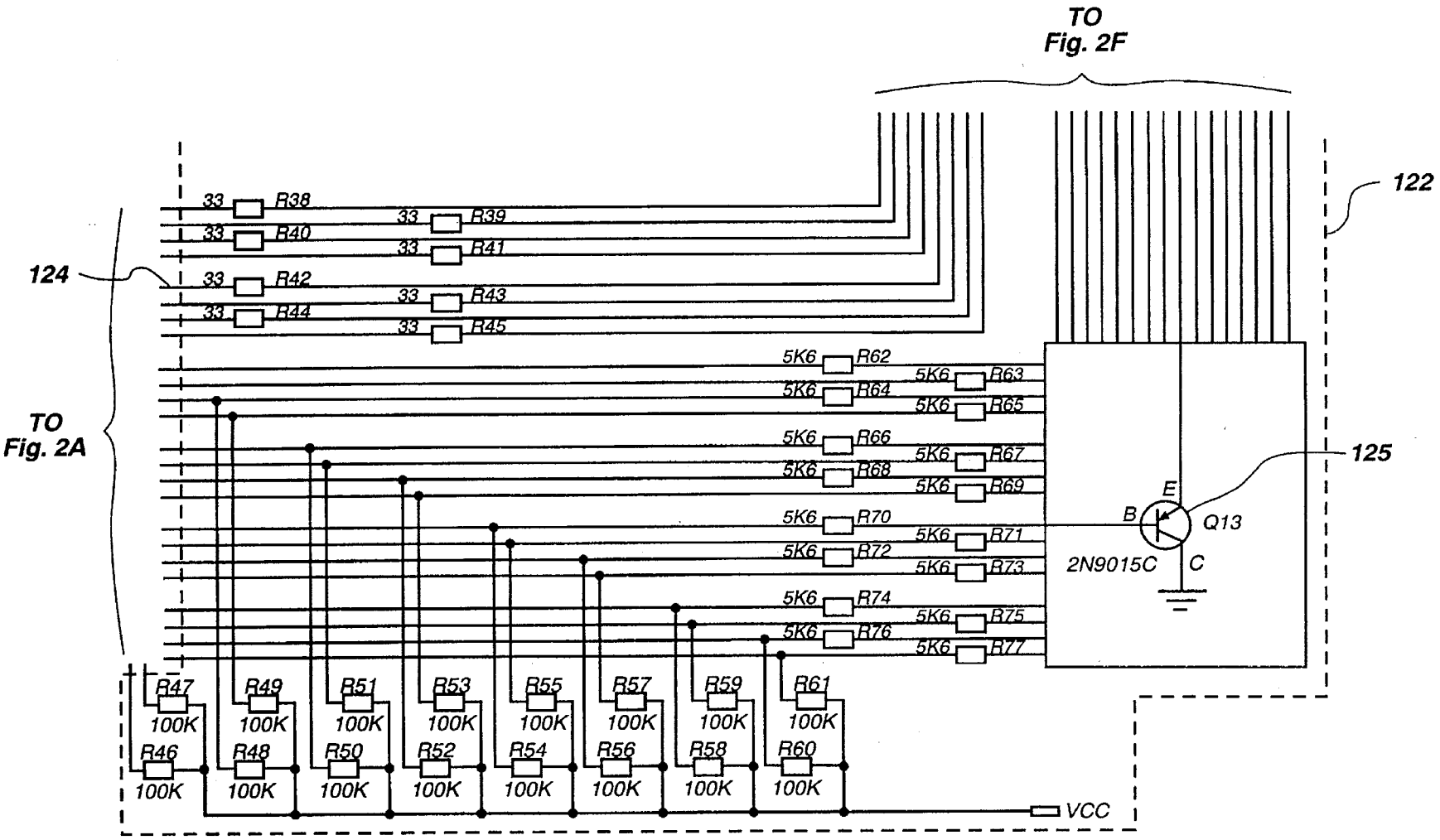
Figure 2F:
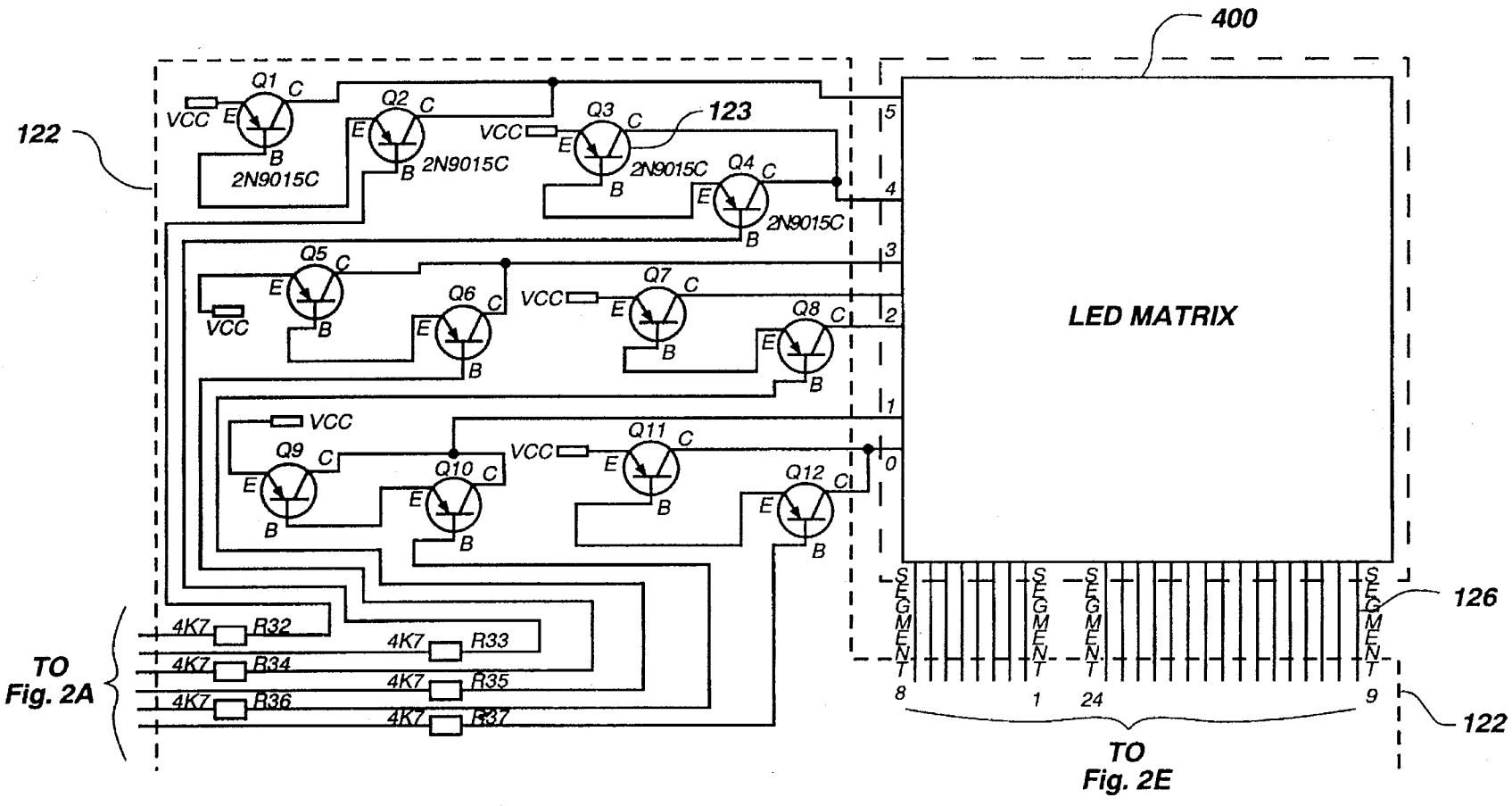

An indicator matrix 400 illustrated in FIGS. 1 and 3 is connected by indicator activation circuit 122 to receive the scanning output signal of keypad scanning circuit 110 and output of the CPU 102 by conductors 114 and 124, respectively (FIGS. 2E and 2F). In the illustrated embodiment, the indicators of the matrix 400 are LEDs; and the indicator activation circuit 122 includes a plurality of transistors such as transistor 123 (FIG. 2F) for causing each of the LEDs to light. The indicator activation circuit 122 has a capacity to activate 144 indicators. However, in the embodiment of FIG. 3 the indicator matrix only contains 80 LEDs.

CPU 102 also provides output signals to control an exercise machine motor controller. The motor controller constitutes difficulty adjustment means which adjusts the difficulty level of the exercise. The motor will have different functions depending upon the particular exercise machine being controlled.

For a treadmill, the difficulty adjustment means may adjust the treadmill track speed and/or the treadmill incline by means known in the art, for example, motor devices as described in the parent application Ser. No. 07/306,872, now U.S. Pat. No. 4,998,725.

Figure 17:
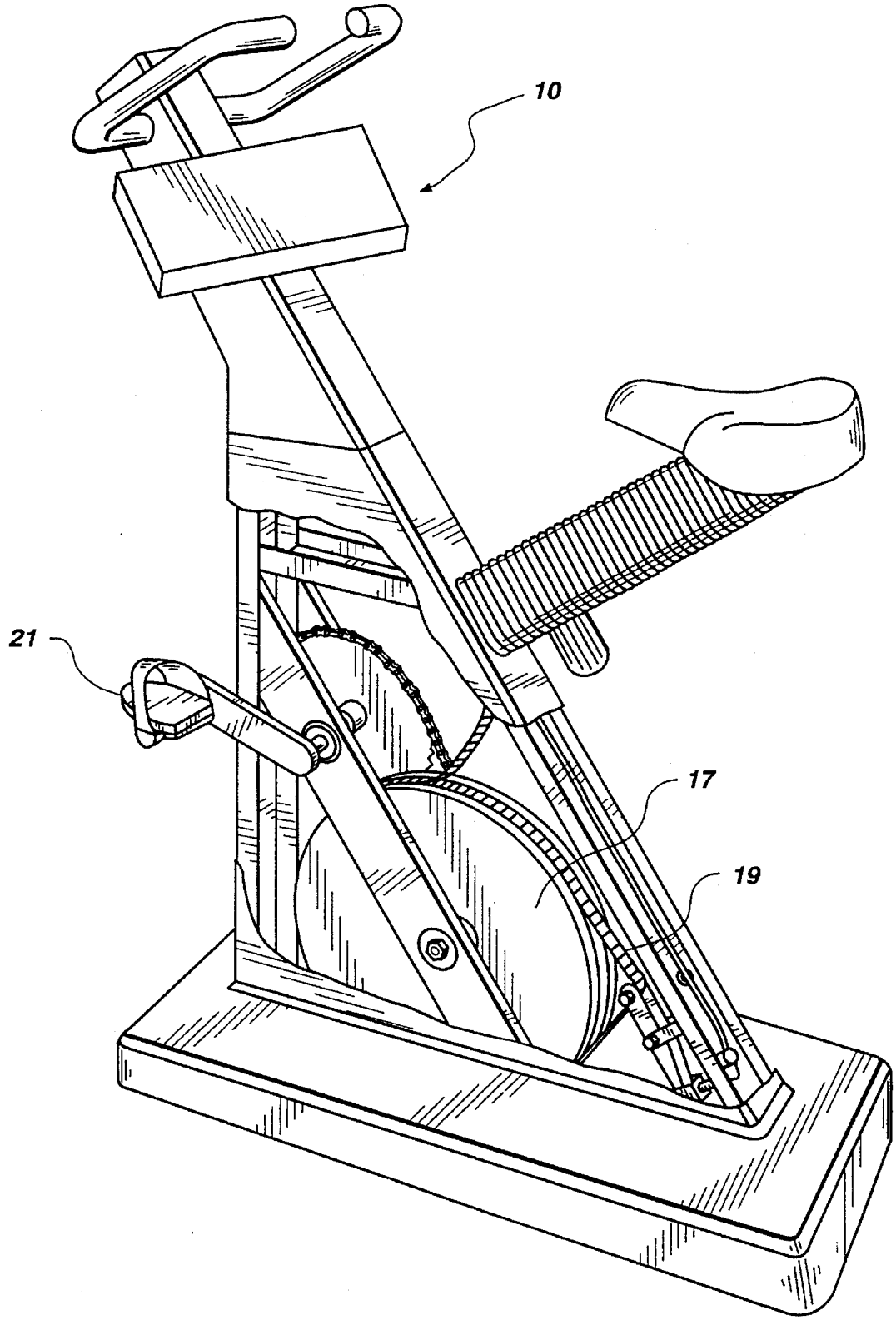
FIG. 17 depicts an exercise cycle with a computerized console of the invention mounted thereon.

For an exercise cycle embodiment, the difficulty adjustment means may be any typical means for offering resistance to the flywheel 17, for example a strap 19 as described in the related copending application Ser. No. 07/415,160 (FIG. 17). The difficulty adjustment means will in any case be connected by conductor(s) to the computation means 100 to receive the difficulty control signals.

Figure 1A:
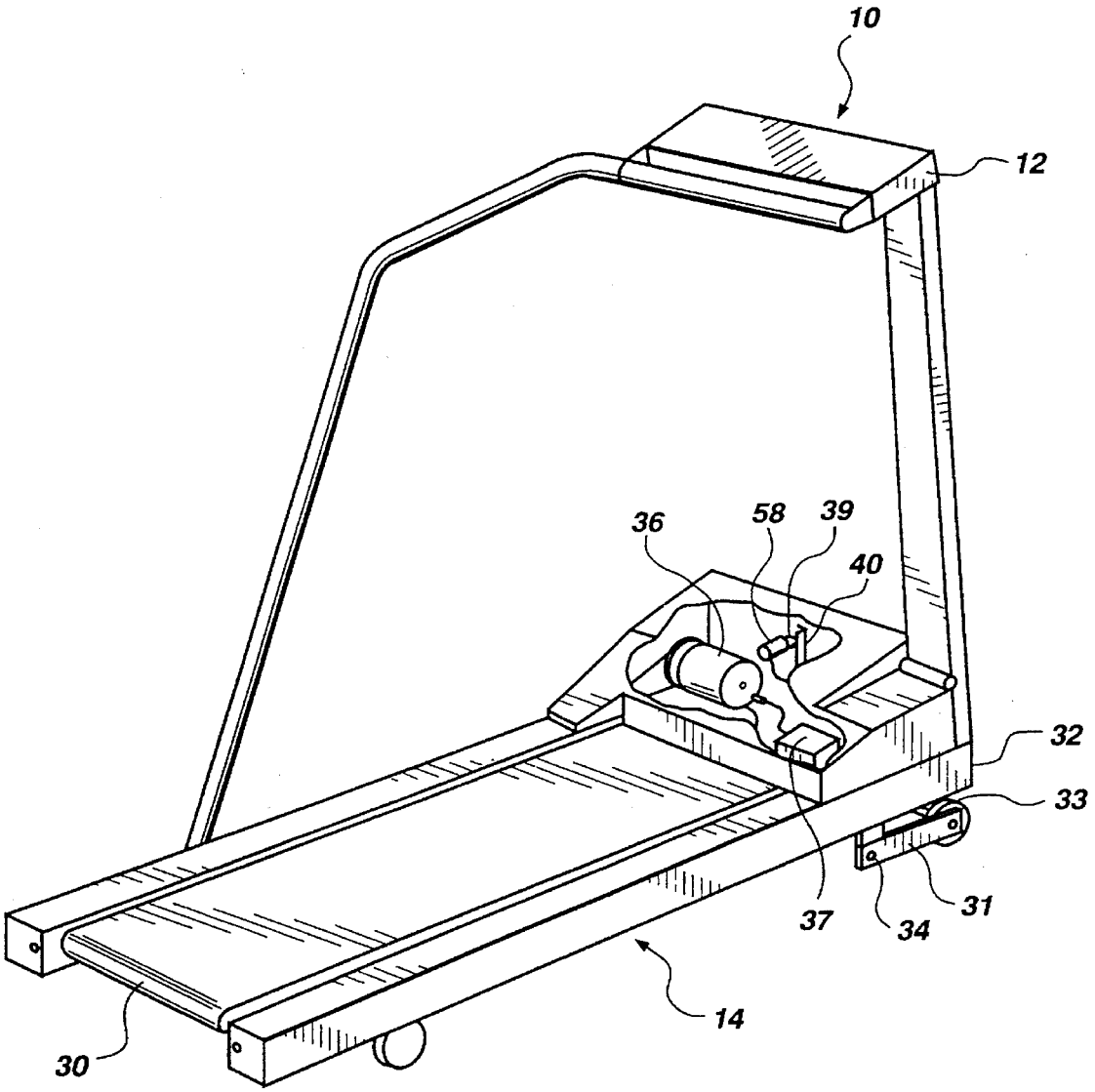
FIG. 1A is a perspective view of a treadmill with a control console secured thereto.
Figure 1B:
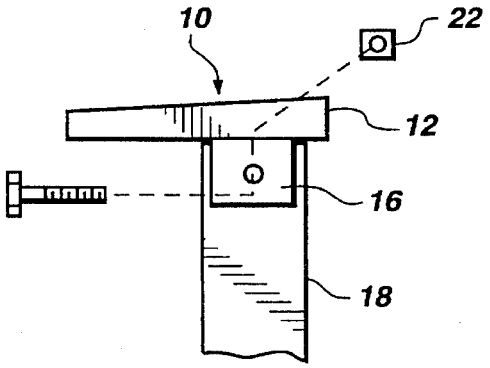
FIG. 1B is a cross section of a portion of the control console and treadmill of FIG. 1A.

As shown in FIG. 1, the difficulty control signals are provided by CPU 102 through conductor 128 to a digital-to-analog (D/A) conversion means 130 (FIG. 2C). D/A conversion means 130 is in turn connectible to an exercise motor controller via conductor 132 to provide converted control signals. Desirably, a plurality of scaling adaptor circuits 140 (FIG. 2D) is associated with conductor 132 to provide multiple scaling configurations suitable for different motor controllers, as known in the art. More specifically, a treadmill motor such as motor 36 has a motor controller 37 which is operable by a signal to vary the motor speed and in turn the speed of the treadmill belt 30 (FIG. 1A). Different motor controllers require a different electric signal appropriately scaled. Similarly, a motor 38 used to vary the incline of a treadmill or to control the tension on a friction strap about the wheel of an exercise cycle also requires a different level of signal appropriately scaled. Conductor 134 from scaling circuits 140 is associated with a receptacle on the chassis (not shown) to interconnect the computation means 100 via a conductor to the motor controller to control the motor and in turn the difficulty of the exercise being experienced by the user.

As shown in FIG. 2D, the scaling adaptor circuit 140 provides a plurality of connector points which may be interconnected by wire jumpers in a plurality of configurations. In the illustrated embodiment, connection of jumpers across points 142 and 144 adapts the console to a treadmill whose maximum speed is 6 miles per hour, and connection of jumpers across points 146 and 148 adapts the console to a treadmill whose maximum speed is 8 or 10 miles per hour. Such scaling adaptor circuits may also be used to adapt the console 10 to provide an output to control the incline of a treadmill or to tension the resistance strap or brake of an exercise cycle.

The computation means 100 also has a reset circuit 150 (FIG. 2A) connected to supply a reset signal to the CPU 102 via conductor 151. The reset circuit 150 causes the CPU 102 to preset default values for the display means and to preset a program as if program keys had been operated to select certain exercise parameters.

The console 10 further includes power supply means 170 which supplies necessary power to the power circuit 172 in the computation means 100 via conductor 174. The power supply also supplies power to the exercise machine motor(s) via suitable conductor means 176. In the illustrated embodiments, the power supply means 170 receives power from an external power source (for example, a wall electrical outlet) via conductor 178 and includes voltage regulating circuits not shown, but well known in the art, to provide the voltages to the power circuit 172 and to the motor(s). The supply of power to the motor(s) is turned on and off at the console by means of a power switch 436 (FIG. 3). The power circuit 172 distributes power to the components of the computation means 100. Conductors to illustrate the power distribution are not shown to enhance the clarity of FIG. 1.

The chassis 12 includes a graphical program display, program keypad section 300 (FIG. 3). The section 300 includes an indicator matrix 400 comprising a plurality of columns 402 of indicators 404 which in the illustrated embodiment are LEDs (light-emitting diodes). Each indicator is operable between an activated state and a deactivated state. The LEDs 404 of FIG. 3 are thus operable between an illuminated and non-illuminated state.

Figure 4:
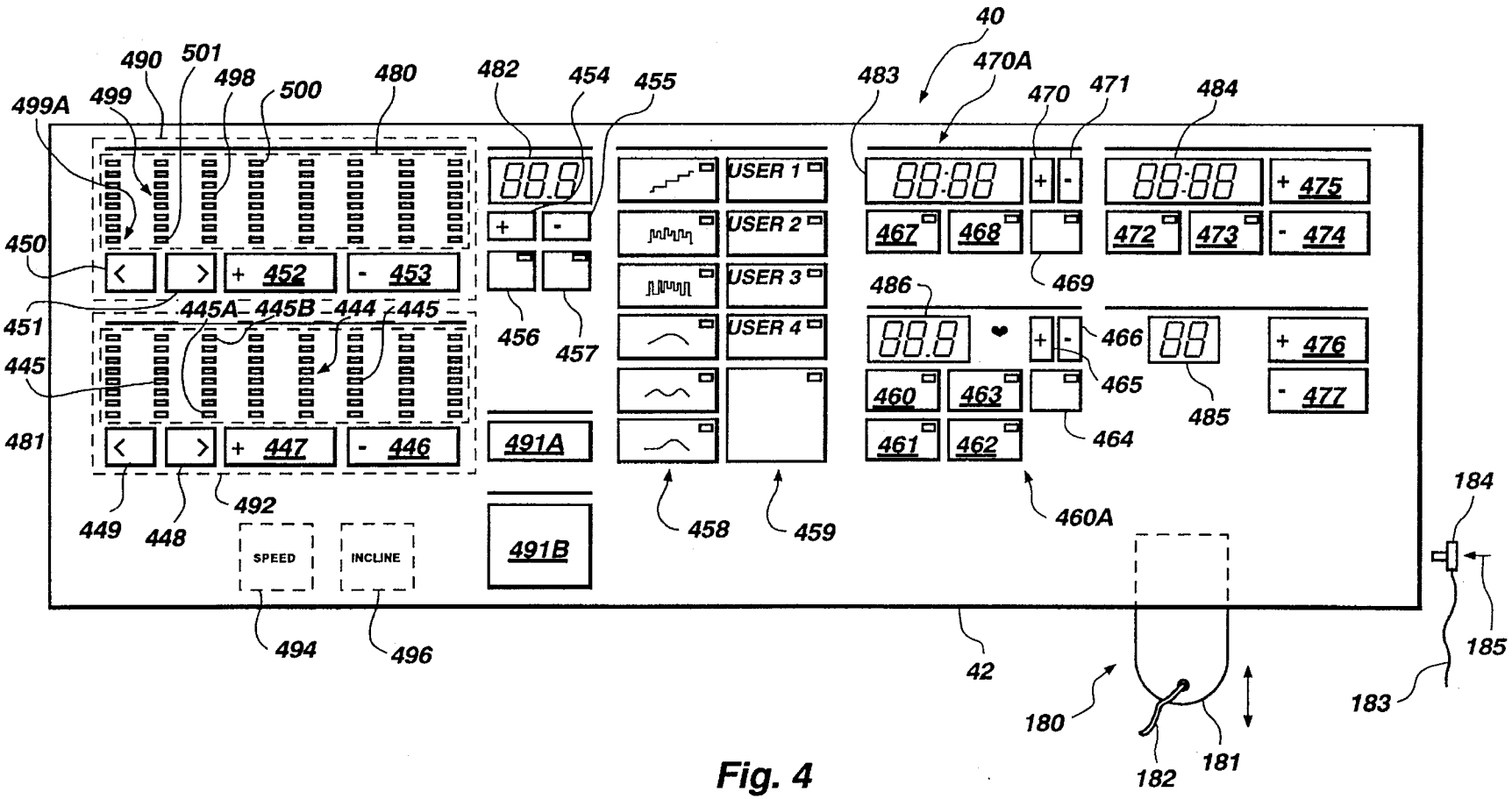
FIG. 4 depicts the chassis of an alternate embodiment of the control console.

Each column 402 represents one time segment of an exercise program. Since the console 10 of FIG. 3 has ten columns 402, the total time period for the displayed program is 100 minutes. In other words, the LED's total time period of the program is divided into N equal time segments by the computation means where N equals the number of LED columns 402. In the embodiments of FIGS. 3 and 4, N is 10 and 8, respectively, but other values of N are within contemplation. Within a column, the relative vertical positions of indicators 404 correspond to different respective difficulty levels of a particular exercise difficulty parameter, in rank order from lowest difficulty at the bottom 403 to highest difficulty at the top 405.

The exercise difficulty parameter may be one of several types depending upon the particular exercise apparatus used with the console. For an exercise cycle, the difficulty parameter would be the resistance to rotation of the pedals 21 by the user (FIG. 17). For a treadmill, the difficulty parameter could be either the speed of the treadmill track, or the incline of the track (higher is more difficult).

FIG. 4 shows an alternate embodiment of a control console 40 of the invention having a chassis 42 with program input means and display means similar to those in FIG. 3. The program input means of the console 40 includes keys 446– 77. The display means includes LED arrays 480 and 481 as well as liquid crystal displays 482–486.

In the alternate embodiment (FIG. 4.), a first program/display segment 490 is provided and a second program/display segment 492. The second program display segment is used to control and display a second exercise difficulty parameter. If the exercise apparatus is a treadmill, segment 490 is configured to govern treadmill speed while segment 492 is configured to govern treadmill incline. In yet another embodiment, a single block 490 may govern either speed or incline depending upon which of the associated "program speed," key 494 or "program incline" key 496 (shown in phantom) have been pressed.

Desirably, the computation means 100 is operable to vary the total time period of the program as well as the time per segment. In FIG. 3, the display means includes a time display 410 with a plus key 412A and a minus key 412B for adjusting the segment time up or down. In the embodiment of FIG. 4, the time display 482 can be alternated between the total time and the segment time depending on which of keys 456 or 457 has been pressed. Either the total time or the segment time can be adjusted by means of plus key 454 and minus key 455.

The difficulty level for each time segment is also indicated in the display by the vertical position of the activated indicator 498 in the corresponding column. That is, in each of the eight individual columns 499, the user-programmed or preprogrammed difficulty level for the corresponding time segment may be represented by having only the indicator corresponding to that level activated. Alternatively, the indicator corresponding to the difficulty level plus all the indicators below it in the column may be activated. In each column 499, the uppermost indicator 500 indicates the most difficult and lowest indicator 501 the least difficult.

The computation means 100 is further operable to compute and supply progress signals to the display means. The display means includes progress display means for providing a visible identifier which distinguishes the column corresponding to the time segment currently in progress during exercise according to either a preset program or a user-designed program. In the illustrated embodiment of FIGS. 3 and 4, the columns of LED indicators 402 and 499 corresponding to the instant time segment in progress have illuminated LEDs which flash on and off to indicate the segment in progress. Only those LEDs which reflect the selected difficulty flash. The left-most column 404A and 499A represents the first time segment, with subsequent time segments represented successively in sequence to the right.

For the console 10 of FIG. 3, a user may enter a user-designed program via user-program selection keys 430 and plus keys 406 and minus keys 408. To enter a program, the user presses one of the program select keys 430 which then lights the LEDs to display the program currently stored for that key. The initial values may be zero (only the lowest LED lit) for all of the time segments, or other values as previously programmed by the user. For each time segment, the user operates the corresponding plus key 406 or minus key 408 as desired to increase or decrease the difficulty level for that segment. When the desired difficulty levels have been entered (as reflected by the activated indicators 404 in each column 402), one of keys 430 is pressed to store or save the program. Once the program is entered under one of keys 420A–420E, it is recalled by pressing that key.

In FIG. 3, it can be seen that each of the ten (10) columns 402 is provided with its own corresponding pair of plus and minus keys 406 and 408. Alternatively, as shown in FIG. 4, arrow keys (< and >) 450 and 451 are provided for selecting one of the eight columns 499 for programming. A single plus and minus key pair 452 and 453 is used to program whichever of the eight columns 499 is selected.

Additionally, the difficulty levels for any segment (as shown in each column 402 or 499) in a user-designed program may be altered during execution of the program (during performance of the exercise by the user). Such alteration is done by operating the plus and minus keys 406 and 408 (FIG. 3) or 452 and 453 (FIG. 4) as described above. The altered program will then be stored at the end of the exercise program.

The console 10 of FIG. 3 is further provided with a "Max Speed Set" segment which includes the display of a selected maximum speed 440, and a plus key 442A and minus key 442B for selecting the desired maximum speed. The display means is constructed to cause the topmost LED indicators 405 (FIG. 3) and 500 in FIG. 4 to represent the selected max speed, which may be equal to or below the maximum speed attainable with the motor associated with the exercise machine to which the console is operably connected. The indicators below then represent proportionate lower fractions of the max speed. In other words, if the maximum speed set is 4 miles per hour for a treadmill, then when the tread 30 speed for a particular time segment is set at 4 miles per hour (whether from a preset program or a userdesigned program), the topmost indicator 405 of the corresponding column will be activated. For the LED array 400 of FIG. 3, each column 402 has eight LEDs 404. Therefore, each LED 404 represents one eighth of the maximum speed set. The default value of the maximum speed is the maximum speed available from the attached motor of the treadmill.

As noted hereinbefore, FIG. 4 depicts an alternate embodiment in which two difficulty parameters are controlled by the console 40 using two separate segments 490 and 492. For example, the first difficulty parameter of a treadmill may be the tread 30 (FIG. 1A) speed; and the second difficulty parameter is the treadmill incline. That is, a motor may operate to rotate the feet 31 of the treadmill away from frame 32 to vary the incline of the tread 30 with respect to the support surface.

In the embodiment of FIG. 4, an additional set of keys 446–449 for setting the maximum incline are provided (FIG. 4). The maximum incline keys 446–449 operate in a manner analogous to the maximum speed keys 450–453 to cause the LEDs 445 to be activated. More specifically, each of the eight columns 444 may be selected by operation of arrow keys 448 and 449 (< and >). The particular angle of inclination of the treadmill 14 is selected by operation of the plus key 447 for higher or larger angles and the minus key 446 for lower or negative. Upon operation, the relative value selected is displayed by illuminating the proportional number LEDs between the lowest LED 445 and highest LED 445B.

In a further embodiment, block 480 and/or block 481 display difficulty levels according to either a preset program or a user-designed program which is entered as described in the preceding paragraphs by the user operating keys 420A–E (FIG. 3) or any one of the keys 1A, the row of keys 458 (preprogrammed) or the row of keys 459 (user programmed) in FIG. 4.

To start execution of a user-designed or a preset program, the user pushes one of keys in the row 458 or row 459, respectively, to select the desired program. The user then pushes program start key 491A. Execution of a program may be stopped at any time by the user by pressing "stop" key 491B.

The console 10 is also operable to control the treadmill exercise difficulty manually by means of keys 438A and 438B (FIG. 3). Speed and in turn the value of the selected speed is shown on LED key array 439 and is similar to a column 402 of the program LED array 400 in that LED indicators corresponding in rank to relative difficulty level, and plus and minus keys 438A and 438B are available for selecting a difficulty level. Alternatively, the manual difficulty level may be displayed digitally as shown in the indicator 484 of FIG. 4 with associated plus and minus keys 475 and 474. The embodiment of FIG. 4 for controlling two exercise difficulty parameters has an indicator with a plus and minus key pair 476 and 477 optimally provided for manually selecting the value of the second difficulty parameter. The second difficulty parameter could for example be the incline angle of a treadmill 14.

The console 40 of FIG. 4 may also include a field 460A for displaying a fitness number, and optionally other variables such as the estimated number of calories being burned or the pulse rate detected by a pulse sensor attached to a user and connected to the computation means. Field 460A includes a digital display 486, a pair of plus and minus keys 465 and 466, a set of variable select keys 460 to 463 for selecting which variable is to be displayed, and a scan key 464 for scanning the selected variables.

The fitness number to be displayed in the indicator 486 is a computed number to reflect the relative fitness for the user. Various factors such as age, weight and sex may be inserted using keys 400 to 403 and the plus and minus keys 465 and 466. The computation means incorporates that information with the value of actual exercise to calculate a fitness number reflecting a relative value and in turn a relative change in fitness over time.

In a further embodiment, the console 40 of FIG. 4 has a distance set feature for the user to set a desired distance and to display the distance actually covered at any point during the performance of the exercise. In FIG. 4, the distance is shown by indicator 483 which is part of a key array 470A. The array 470A may be used to set both time and distance using function select keys 467 and 468. Plus and minus keys 470 and 471 may be used for incrementing the value shown by indicator 483 up or down. Scan key 469 is used to intermittently scan or switch between the time and the distance.

Referring back to FIGS. 2A and 2B, a detailed circuit diagram is depicted. The keypad scanning circuit 110 is shown with a key matrix 160 to reflect the input 111 received from the keypad. The key matrix 160 is read by a microprocessor reading signal sent by the microprocessor 102 via conductors 112 here depicted as a plurality of interconnecting conductors. The output of the keypad scanning circuit is supplied via conductors 114 to the indicator activation circuit 122 and to the microprocessor 102 (FIGS. 2E and 2F).

The indicator activation circuit 122 includes a plurality of transistors such as transistor 123 and transistor 125 to fire the LEDs of the LED matrix 400. Notably, transistor 125 represents a plurality of like transistors each interconnected to the LED matrix 400 by one of a plurality of conductors 126. The indicator activation circuit 122 is also connected to the microprocessor 102 by a plurality of conductors 124.

The digital to analog conversion circuit 130 is also shown connected to the microprocessor 102 by a plurality of conductors and to the scaling adaptor circuit 140 which has an output 134 (FIG. 1) here shown as a plurality of pairs of output jacks 142, 144, 146 and 148. The reset circuit 150 is also shown and was hereinbefore discussed.

Figure 5:
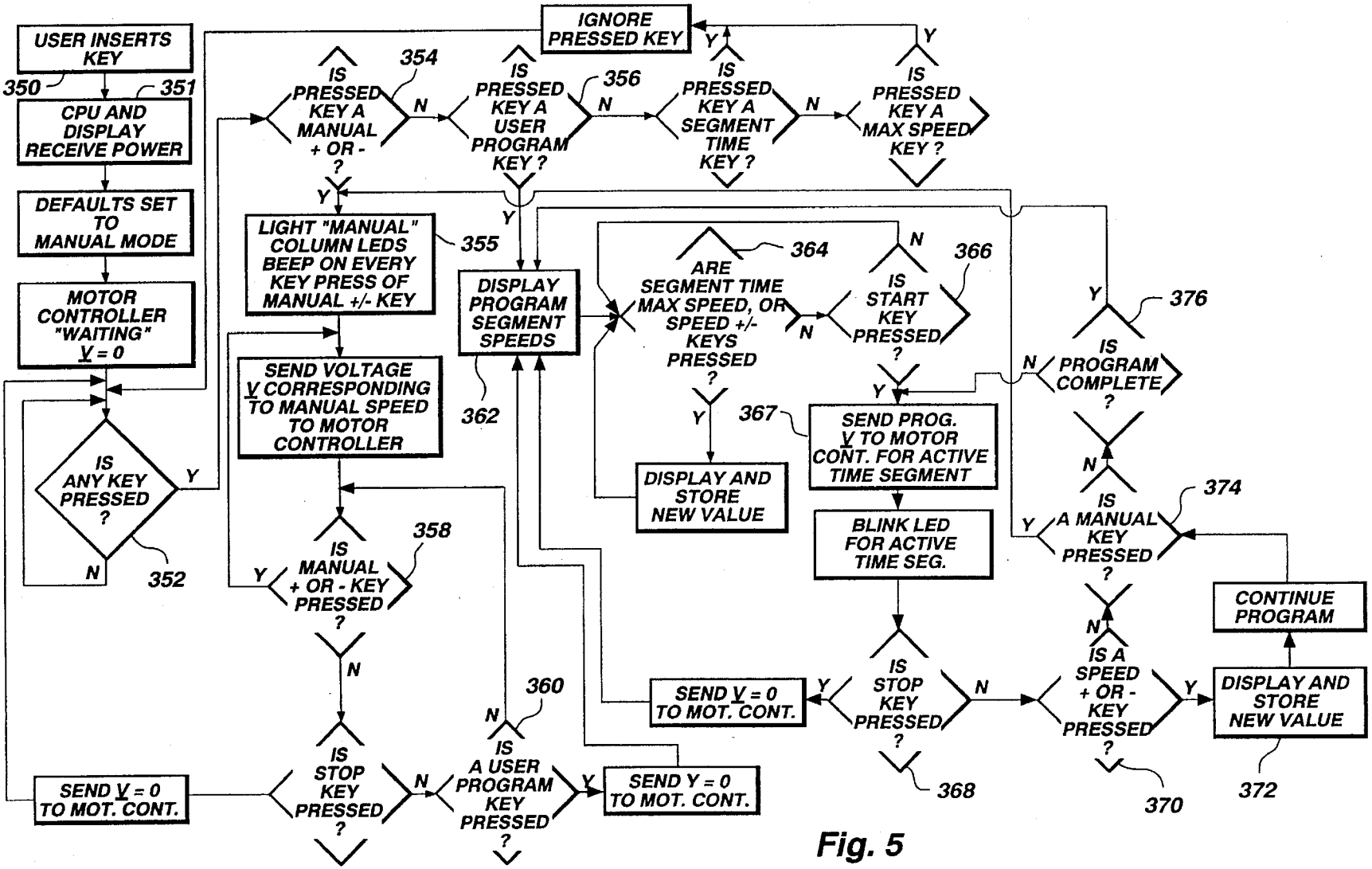
FIG. 5 is a logic flow diagram for the operation of the computation means of the console.

FIG. 5 is a logic flow diagram of the operation of the console 10. Once the associated exercise machine is set up and placed into operation, it is preferred to leave it plugged into a source of power to retain the memory. Once power is applied to the console, the user may operate the console to regulate the associated exercise machine and for the embodiment of FIGS. 3 and 4, a treadmill.

Preferably, the console 10 of FIG. 3 and the console 40 of FIG. 4 are configured with a safety switch such as the switch 180 shown in FIG. 4. That is, a safety key 181 is inserted into an appropriate slot formed in the chassis 42 to operate an electrical switch and in turn enable the console 40 and in turn the exercise machine such as treadmill 14 (FIG. 1A). The safety key 181 has a lanyard or line 182 which may be connected to the user. In the event the user leaves the tread 30, the length of the line 182 is such that the key 181 will be extracted from the slot thereby deactivating the motor and in turn the tread 30. In reference to the program outlined in FIG. 5, the enabling action effected by insertion of the key 181 is shown as the first step. Thereafter, the program directs the application of power 351 to the CPU 102 and the remaining components of the consoles 10 or 40. Upon activation, the program defaults to a manual mode and places the motor controller in a waiting or "stand by" mode. Insertion of the DMK by a user causes power to be sent to the CPU and displays (350). The CPU defaults to the manual mode, and the motor controller is set to a "waiting" mode.

The computation means 100 then asks if a key (any key) has been pressed (352). If yes, the computation means 100 asks if the key is one of manual plus or minus keys 438A and 438B (FIG. 3) (354). If no, the computation means 100 asks if the depressed key is one of the user program keys (356). If the answer to 354 is yes, the computation means lights the manual column LEDs, beeps on every key press of one of manual plus or minus keys 438A and 438B, and sends voltage V to the speed motor controller to operate the treadmill at the speed selected via keys 438A and 438B. The computation means 100 then asks if the stop key 434 has been pressed (358). If yes, the computation means 100 sends voltage V=0 to stop the speed motor and returns to step 352. If the stop key 434 is not pressed, the computation means 100 asks if a user program key 420A–E has been pressed (360). If no, the computation means 100 returns to step 358, looping through the question sequence while continuing to operate the motor controller at the selected speed. If the answer to 360 is yes, the computation means sends voltage V=0 to stop the speed motor and goes to the user program loop at block 362.

The operation of the user program loop begins when the user presses one of user program keys 420A to 420E, at either of decision points 356 or 360. Once a user program key 420A–420E has been pressed, the computation means 100 then causes activation of the LEDs for the respective speed for each time segment 402 as specified by the program corresponding to the pressed key. The computation means 100 then asks whether any one of the segment time keys 412A and 412B, max speed keys 442A and 442B, or speed set plus keys 406 or minus keys 408 have been pressed (364). If yes, the computation means 100 causes the display and storage of the new value and returns to decision point 364. If no, the computation means 100 asks whether the start key 432 has been pressed (366). If no, the computation means 100 returns to decision point 364. If yes, the computation means 100 sends voltage V to the motor controller to correspond to the selected speed for the active time segment, and blinks the lit LED for that time segment.

Next, the computation means 100 asks if the stop key 434 is pressed (368). If yes, the computation means 100 stops the motor and returns to block 362 of the user program loop. If no, the computation means 100 asks if one of speed set plus keys 406 or minus keys 408 have been pressed (370). If yes, the computation means displays and stores the new value (372) while continuing to execute the program. If the answer at decision point 370 was no, or after the computation means 100 has entered a new program value at block 372, the computation means 100 next asks if a manual key 438A or 438B has been pressed (374). If the answer is yes, the computation means 100 exits the user program loop and goes to block 355 to enter the manual loop. If no, the computation means 100 asks if the program is complete (376). If yes, the computation means 100 returns to the start of the user program loop at block 362. If no, the computation means 100 returns to block 367 and continues to cycle through the question loop including decision points 368, 370, 374 and 376.

Thus, in accordance with the logic of computation means 100, a user can switch at any time between a manual mode and a user program and vice-versa. Also, a user can enter a new segment speed value in a user program at any time during performance of that user program or at the beginning of the program.

In operation, control consoles 10 and 40 of FIGS. 1–4 may be adapted to an exercise machine such as the treadmill disclosed in parent application Ser. No. 07/306,872. Typically, the consoles 10 and 40 are placed on a post or bar at waist height in front of the user as known to those skilled in the art. The user positioned on the exercise treadmill will first energize the treadmill 14 and in turn the console. A power on-off switch 436 may be provided on the console itself or on associated consoles adjacent to the console of FIG. 3. Thereafter, the user operates the start and stop switches 432, 434 to start and stop the treadmill 14. The user will also use the program switches 420A–E to select the desired form of the exercise to be performed. The increase switches 406 and decrease switches 408 may be used as described previously herein to set the appropriate values in the segment columns 402 of the LED display 400 and in turn in the computation means 100. In operating the exercise machine with the use of the control console of FIG. 3, the user is thus able to control a difficulty parameter of the exercise being performed on the machine.

Figure 6:
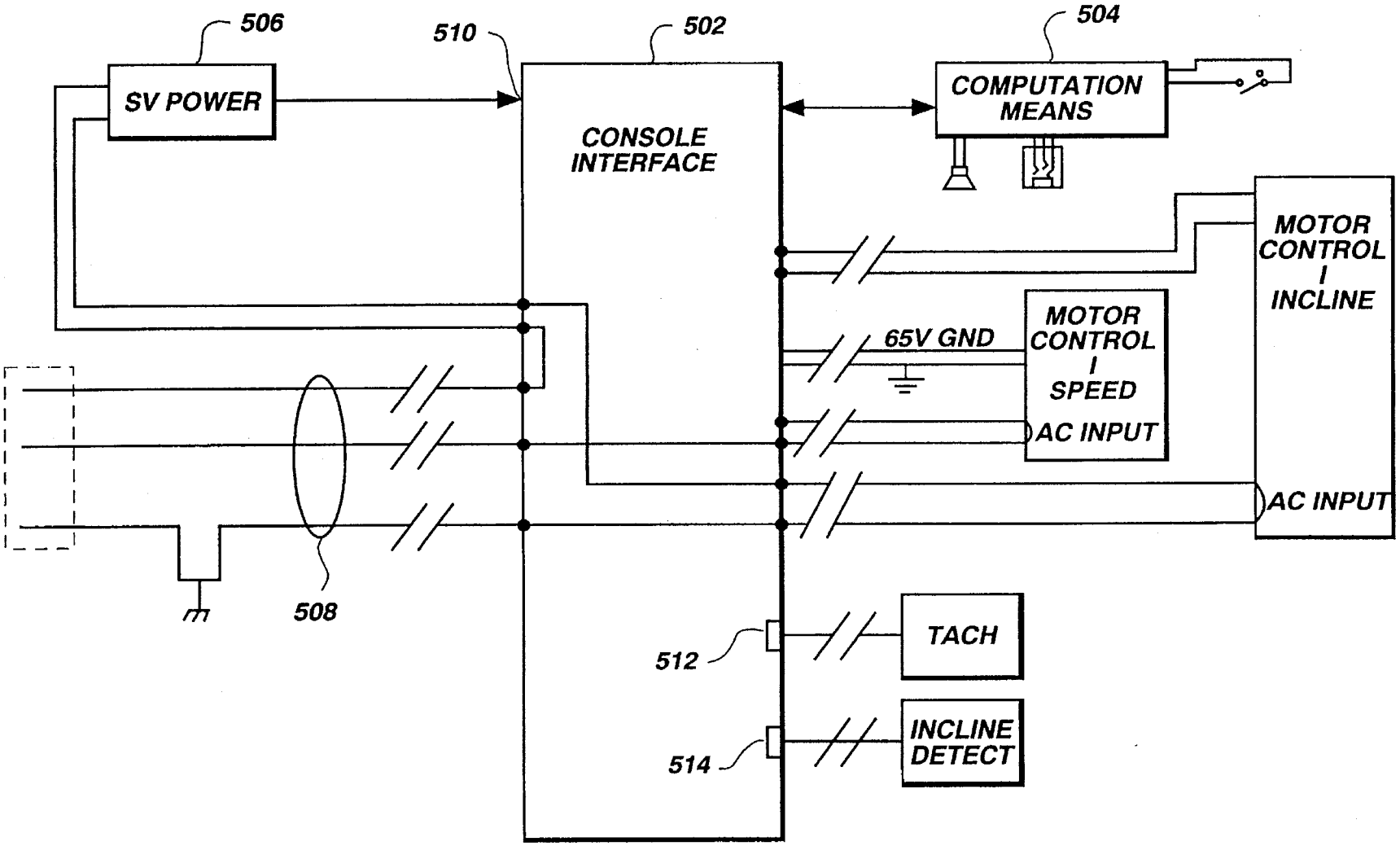
FIG. 6 is a block diagram of an alternate embodiment of a console of the invention in association with elements of an exercise machine.

An alternate embodiment of a console of the invention is illustrated in FIGS. 6–12. FIG. 6 is a block diagram of the console which has displays the same as or similar to those shown in FIGS. 3 and 4. Also, the operation of the keypad by a user for inputting a user-designed program, selecting and executing the user-designed or preset program, selecting time, and the like, are the same as previously described for the embodiment of FIGS. 1–4. However, the embodiment of FIGS. 7–12 is constructed to provide feedback control of the speed of an exercise machine, and includes an optical ground isolator for isolating the computation means from the non-zero voltage ground of motor controllers typically used with an exercise machine such as a treadmill.

The block diagram of FIG. 6 includes a console interface 502, a computation means 504, a five volt power supply 506, and power connection 508 to 120 volts external power. Computation means 504 constitutes the computation means of the console, and is connected to console interface 502 to receive power and to receive and send signals to motors controlling the exercise machine. Computation means 504 is also connected to receive exercise machine detector signals reflective of exercise machine movement parameters via console interface 502. In a treadmill, such detector signals would include the treadmill speed and/or incline angle. Console interface 502 may be positioned proximate the motor controller(s) or tachometer (for example, under the tread platform), and away from the CPU. All that is required is that console interface 502 be electrically connected to computation means 504 as illustrated.

Console interface 502 provides various electrical connections and converts some of the inputs to electrical signal forms which can be used by the computation means 504. Console interface 502 also converts certain signals received from computation means 504 to signal forms suitable to control motors, etc., associated with the exercise machine moving parts. Power connection 508 connects console interface 502 to a typical 120 volt alternating current source such as an electrical outlet. Five volt power supply 506 is connected to console interface 502 to receive outlet power (e.g., 120 volts ac) and also is connected to the main power input 510 of the console interface 502 to provide +5 volt and +12 volt power to operate console interface 502 and other console components.

In the illustrated example, the console is for a treadmill having a variable tread speed through the use of a visible speed motor and an incline angle which is adjustable by use of a motor secured to the frame 32 which drives a pinion 39 interconnected to a rack 40. The rack 40 in turn is connected to the shaft 33 of the support feet 31 which rotate about pivot 34. The incline of the frame 32 to the support surface is thereby varied by operating the motor to drive the rack. Other arrangements may be used as desired.

Tread speed tachometer input 512 and incline position detector input 514 of console interface 502 are connectable to detectors for the incline and the speed of the treadmill, respectively. Outputs 512 and 514 provide both 120 volts ac to power incline and tread speed motors, and control signals generated by the computation means 100 to control the incline angle and speed. The incline position detector may be a single rotatable potentiometer to supply a variable or stepped resistance with changing angles of incline. Alternatively, the rack or similar member may have a series of photo reflective devices. A photo detector may be positioned proximate the rack to read the photo reflective devices.

Additionally, console interface 502 includes an optical ground isolator (not shown) for isolating the rest of the exercise machine and console from the "ground" level of the motor controllers. Since the motor controllers utilize a non-zero voltage as ground, which may be as much as 65 volts, it is desirable to reduce the risk of electrical shock to users or other persons assembling and setting up the machine. Also, vibrations of the machine in use could eventually cause a short, exposing the user to electrical shock. The optical isolator reduces the risk.

Figure 7:
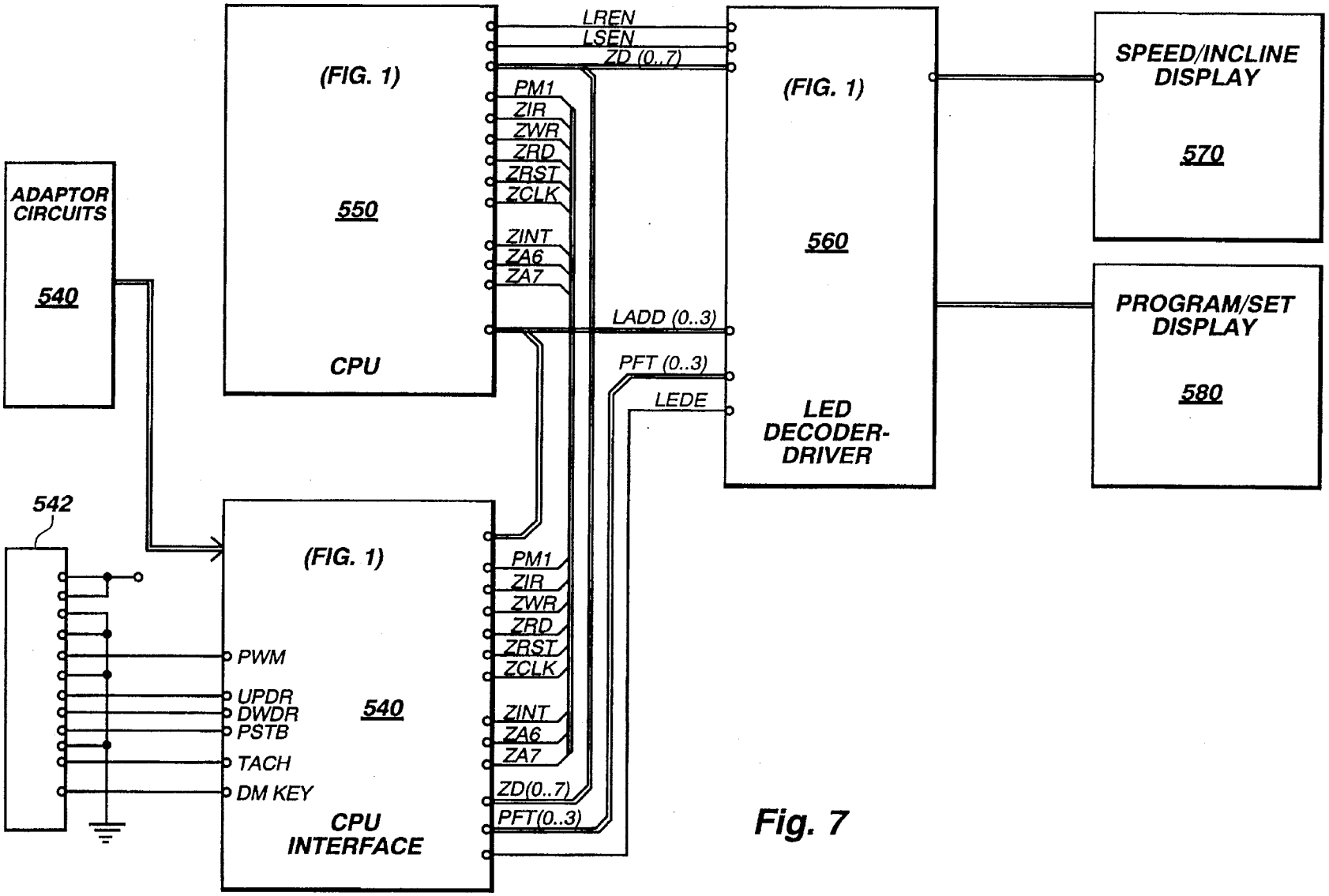
FIG. 7 is a block diagram of the alternate embodiment of the console.

FIG. 7 is a block diagram of a computation means 504 of the alternate embodiment. A CPU interface means 540 is connectible via a pin plug 542 to provide output signals to a treadmill incline motor to move the incline up or down (UPDR and DWDR) and pulse width modulator signals (PWM) to a treadmill speed motor. Interface means 540 also receives input signals from the safety switch 180 (DMKEY), the treadmill tachometer (TACH), and data from a series of scaling adapters 544 similar to scaling adapters 140 described for FIGS. 1 and 2. The specific connections of the jumpers in scaling adapters 544 define the type of speed motor connected to the exercise machine and the computation means. Interface means 540 processes the input signals and is connected to provide these processed input signals to a central processing unit 550 (referred to hereafter as CPU 550). Interface means 540 also receives operating signals from CPU 550 and processes these to produce the output signals UPDR, DWDR, and PWM.

CPU 550 is also connected to an LED decoder 560 which is in turn connected to speed/incline LED display 570 and program/set LED display 580.

Figure 9A:
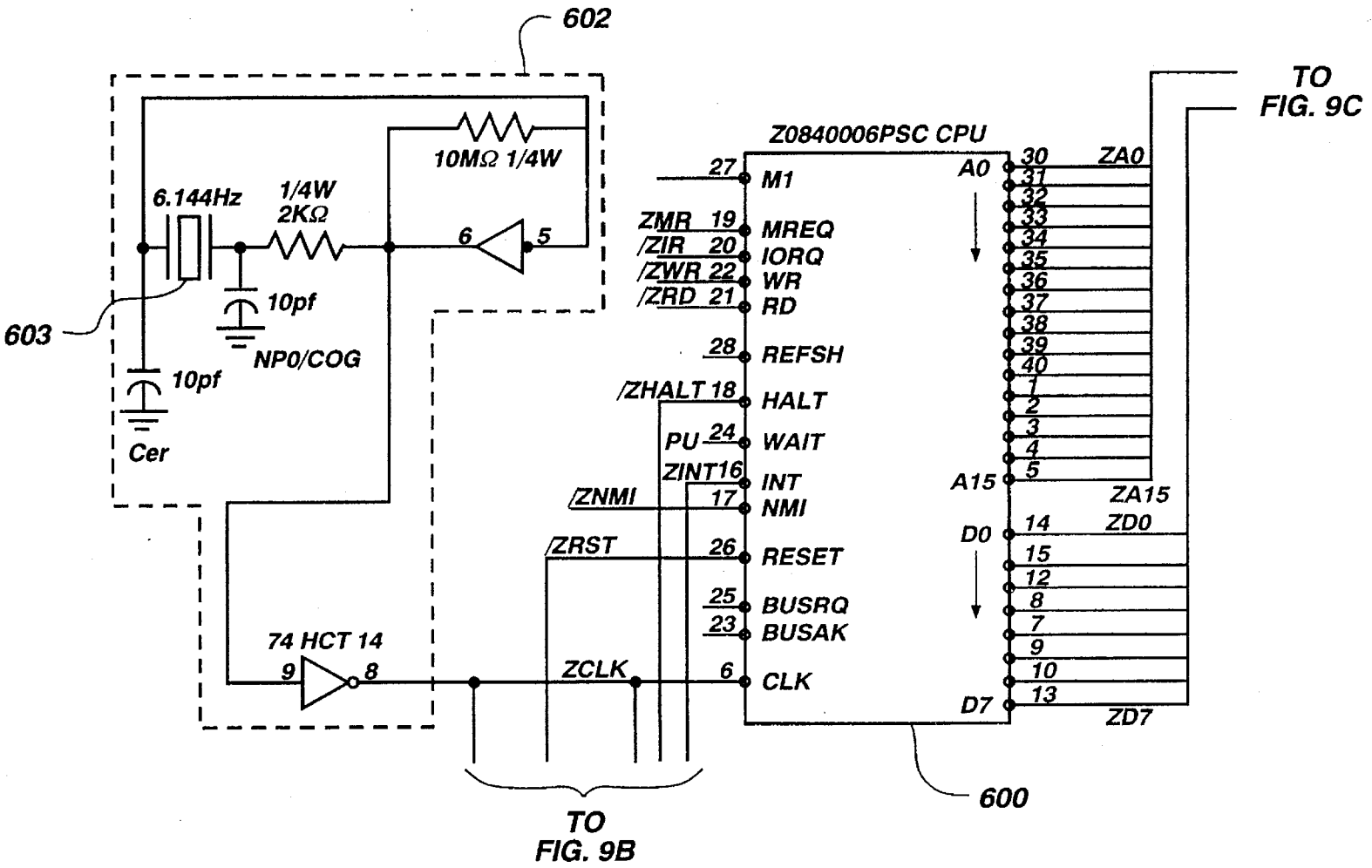
FIGS. 9A, and 9B, 9C, and 9D are schematic diagrams of circuitry for a working embodiment of Central Processing Unit of the alternate embodiment of the console.
Figure 9B:
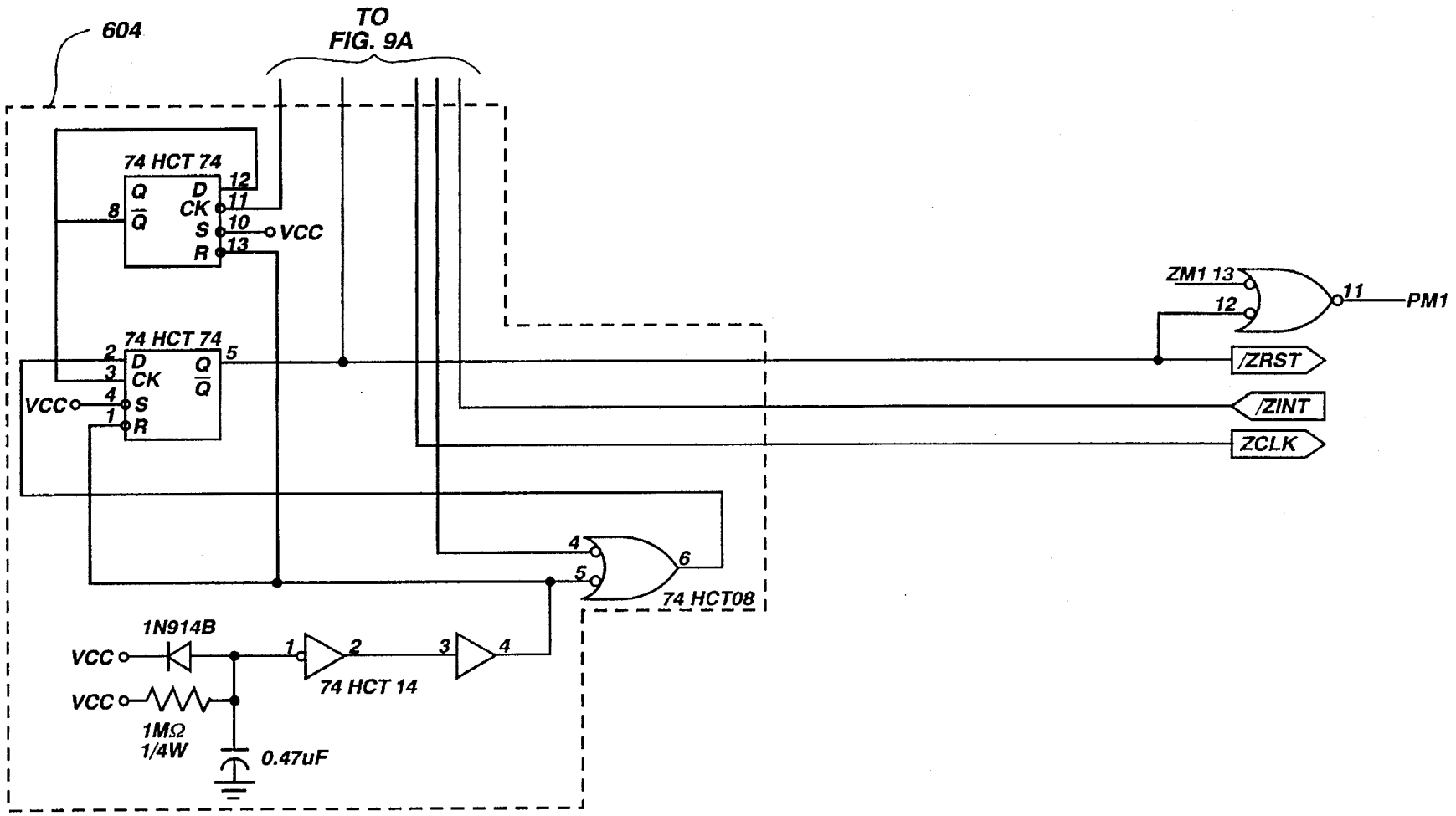

FIGS. 9A–9D depict circuitry of a working embodiment of CPU 550 in greater detail. A CPU chip 600 is connected to a clock circuit 602 and a reset circuit 604 (FIGS. 9A and 9B). Reset circuit 604 resets computation means 504 to a set of initial values when it determines that "nonsense" data or commands are being generated by CPU chip 600. Clock circuit 602 includes a crystal clock 603 and provides time signals to the CPU chip. CPU chip 600 is a "core microprocessor chip" as known in the art. It executes instructions received from a ROM and/or RAM. In the illustrated embodiment, CPU chip 600 is a Z0840006PSC.

Figure 9C:
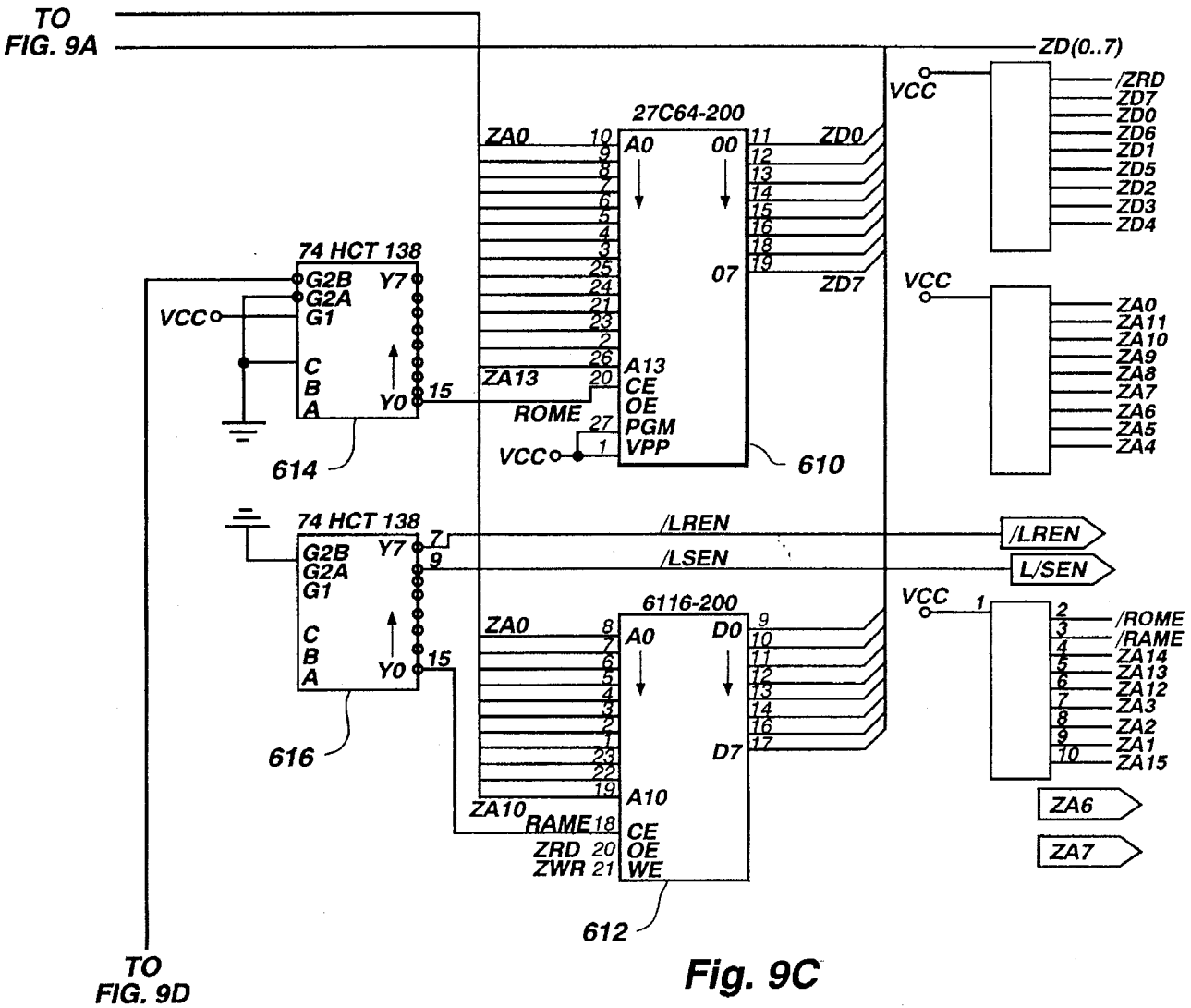
Figure 9D:
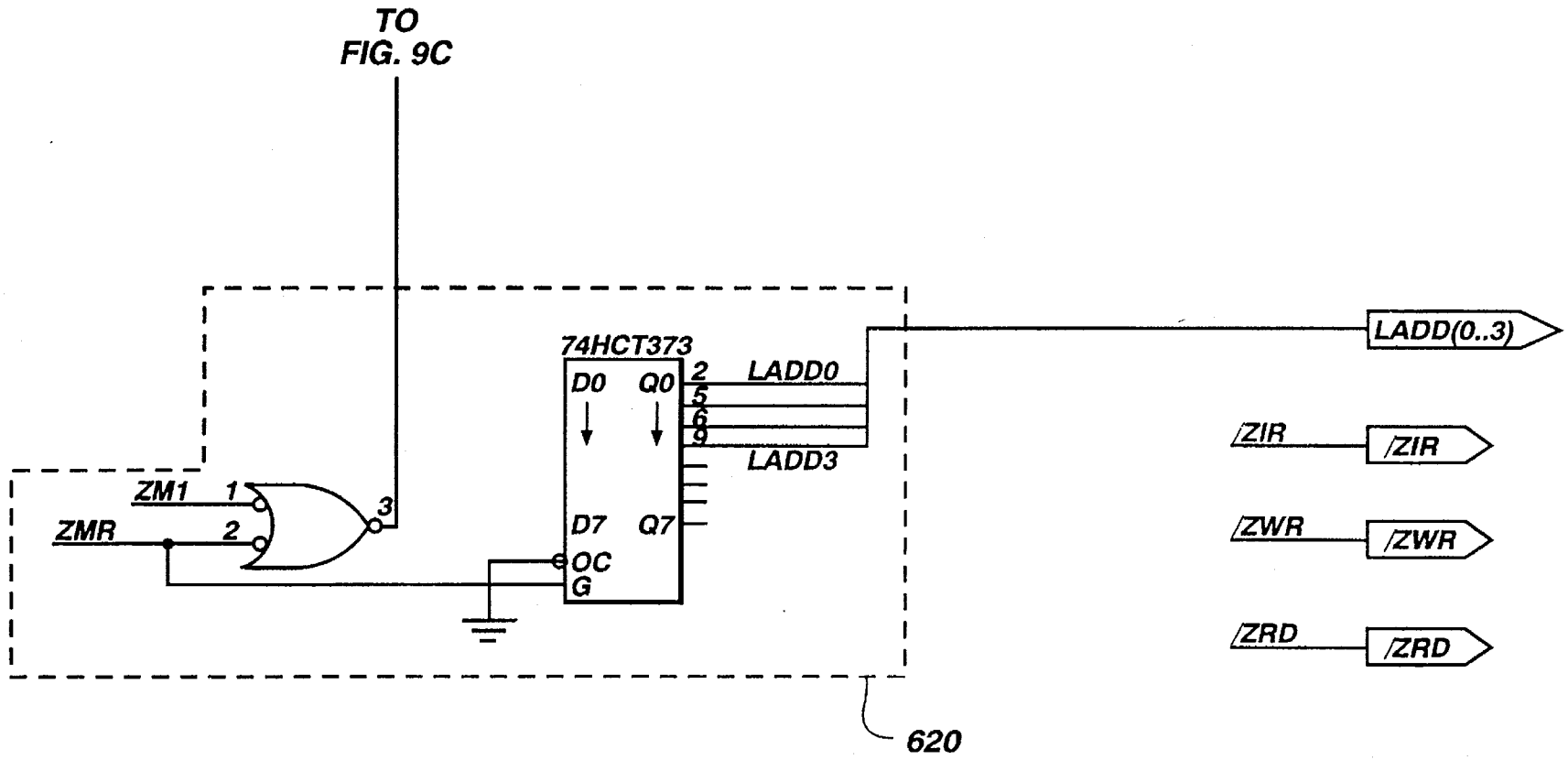

CPU chip 600 is connected to read data from a ROM 610 and a RAM 612 (FIGS. 9A and 9C). ROM 610 is an 8K×8 or 16K×8 memory chip containing all of the basic software for operating the console. It may also take the form of an EPROM (Erasable Programmable Read Only Memory), an OTPROM (One-Time Programmable Read Only Memory), or a standard ROM. In the illustrated embodiment, ROM 610 is an 8K×8 ROM, the 27C64- 200 chip. RAM 612 is a random-access memory device which receives data from the ongoing operations of the exercise machine and console and provides signals reflective thereof to CPU chip 600. In the illustrated embodiment, RAM 612 is a 6116 chip. Address decoder chips 614, 616 are associated respectively with ROM 610 and RAM 612, as known in the art. A latch buffer circuit 620 (FIG. 9D) is also connected to ROM 610 to latch certain data to preselected values.

Figure 8A:
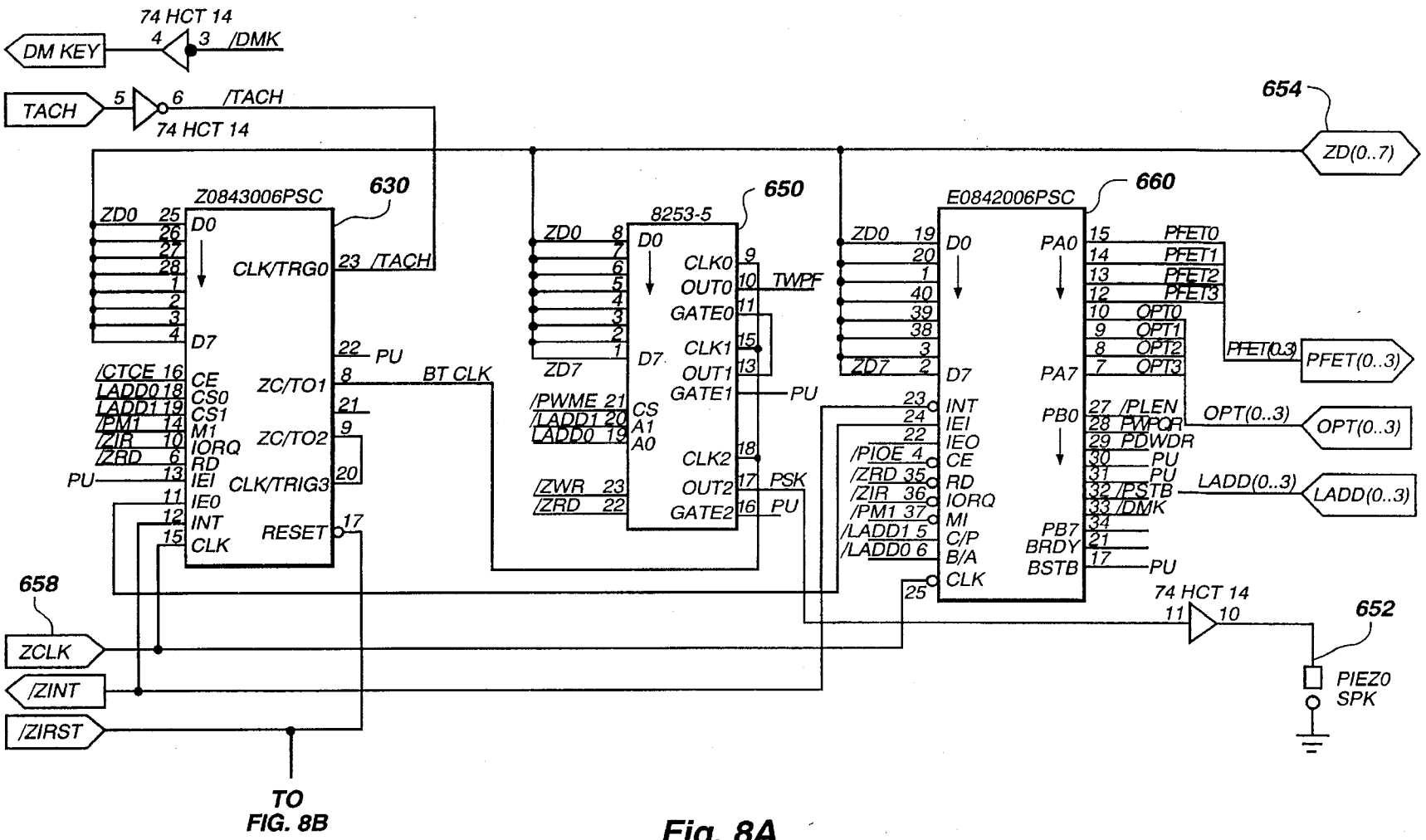
FIGS. 8A, and 8B schematic diagrams of circuitry for a working embodiment of Central Processing Unit interface board of the alternate embodiment of the console.
Figure 8B:
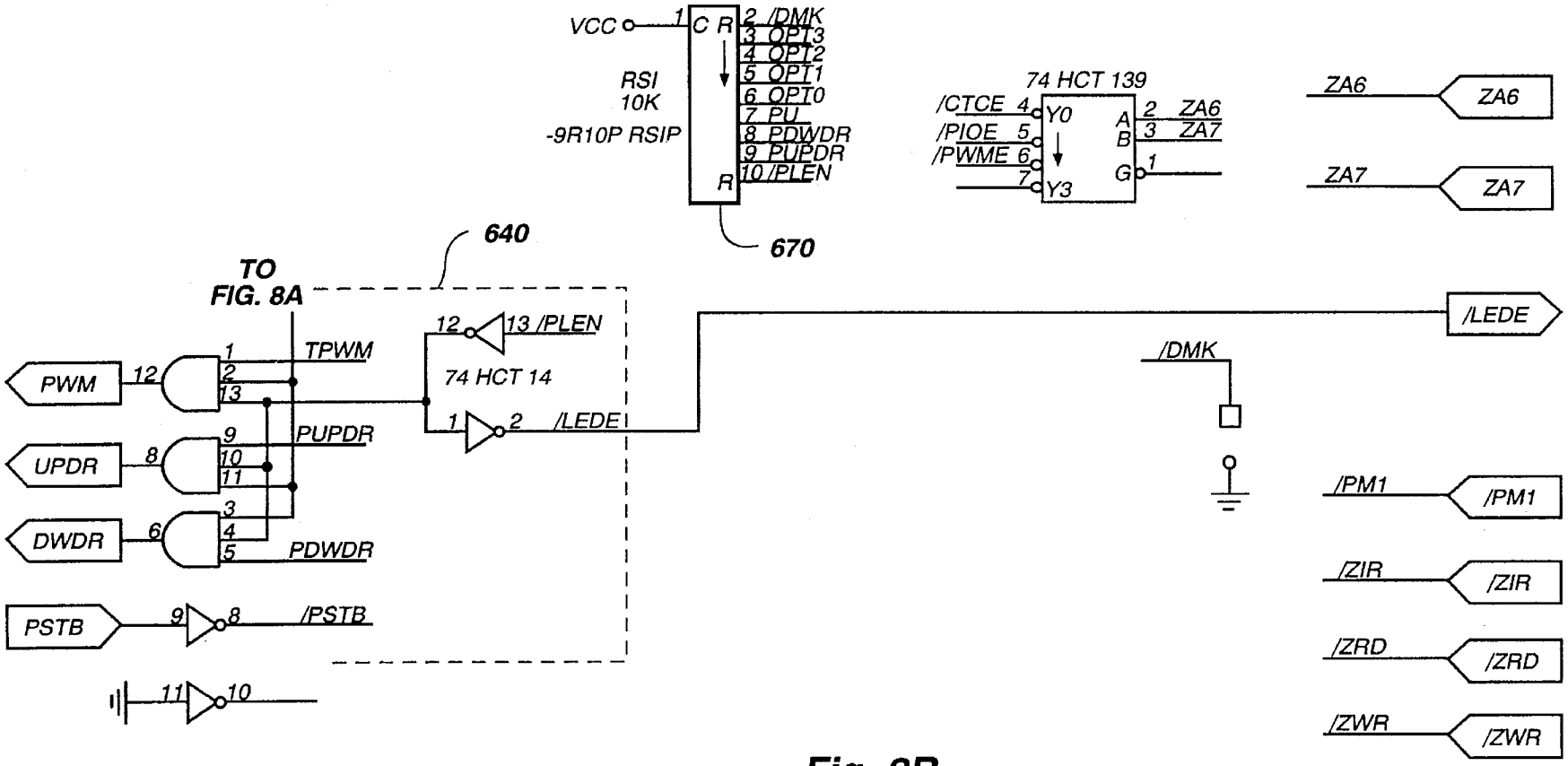

FIGS. 8A and 8B depict circuitry of an interface means 540 for a working embodiment of computation means 504. Interface means 540 includes a counter/timer chip 630 (FIG. 8A) which is connectible to count pulses from a tachometer associated with the treadmill and to reset logic circuit 640 (FIG. 8B). An interval timer chip 650 produces a pulse width modulated signal which can be sent to a motor controller to control the treadmill speed. Interval timer chip 650 may also be used to generate audible signals via a piezo speaker or buzzer 652. Interface means 540 also includes a parallel input/output chip 660 which activates the LEDs by signaling to a plurality of PFET (Power Field Effect Transistors) transistors. Plug or pin strip 670 (FIG. 8B) connects interface means 540 to the input power or voltage VCC, the safety switch (DMK) and the jumper option circuits (OPT [0 . . . 3]), and is also connectible to the incline motor controller. Interface means 540 connects to receive and send signals to data registers D [0 . . . 7] or the RAM 612 and ROM 610 via the input/output cable 654, to the LED array via connector 656, to clock circuit 602 via connector 658, and to the latch buffer circuit 620 LADD [0 . . . 3], all of which are incorporated in CPU 550 in the working embodiment.

Interface means 540 is also connectible to receive inputs from an incline photo detector (connections designated ZINT) and a tachometer (connections designated TACH). The interface 540 is constructed to provide processed signals from these inputs to CPU 550 in a format which is readable by the CPU 550.

Figure 10:
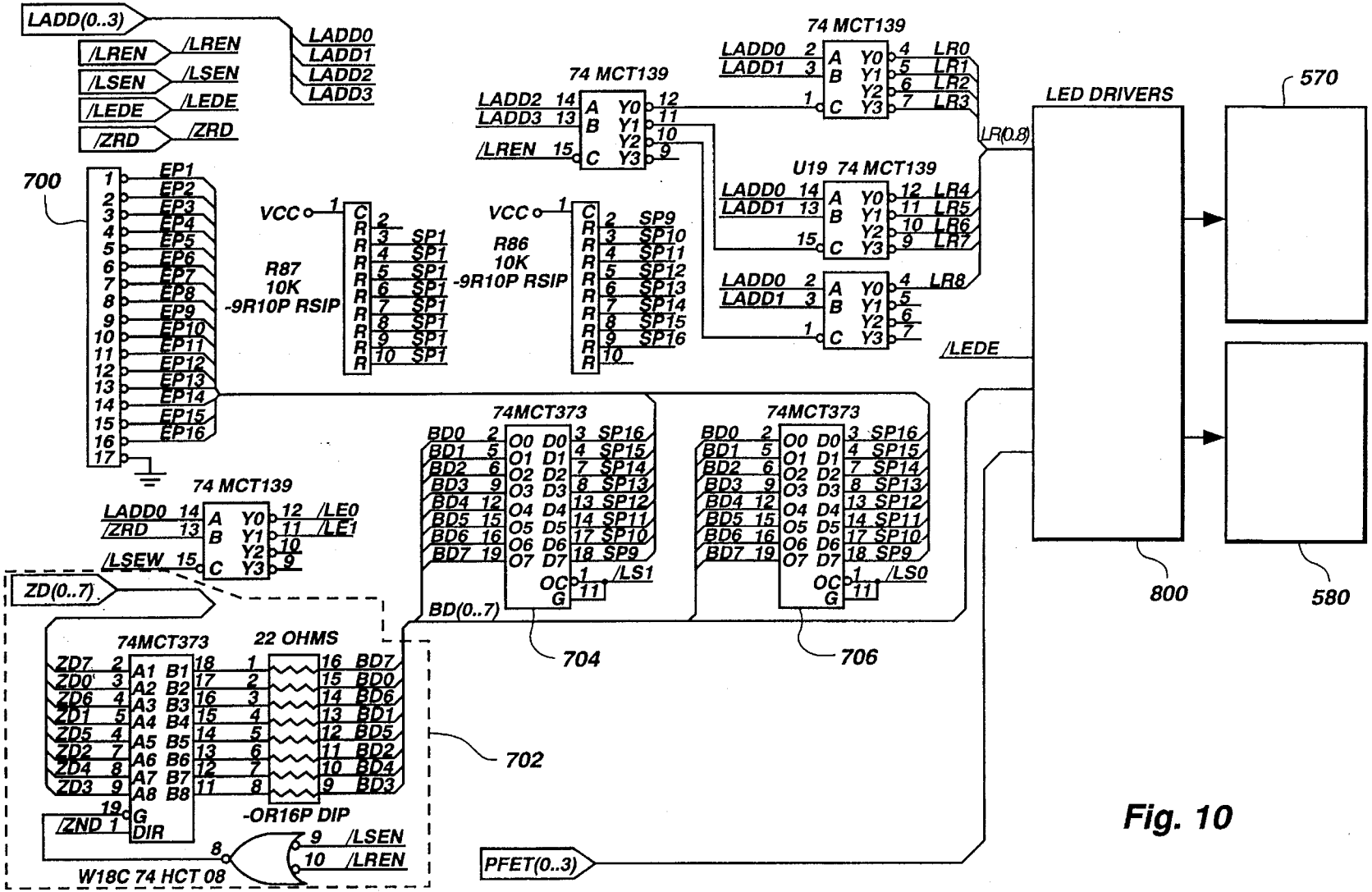
FIG. 10 is a schematic diagram of circuitry for a working embodiment of LED decoder-driver of the alternate embodiment of the console.

FIG. 10 depicts circuitry for an LED decoder 560 of FIG. 7 in greater detail. LED decoder 560 includes a switch panel 700 which connects to the switches of the displays similar to the displays of FIGS. 3 and 4 and a bi-directional buffer 702 which both sends and receives display signals from CPU 550. A pair of latching buffers 704, 706 are connected as shown between switch panel 700, bi-directional buffer 702 and LED driver 800. Transistor circuit 710 is also included in decoder 560 for powering or firing the LEDs. In the working embodiment, the LEDs are divided into four banks which are multiplexed by CPU 550. As known in the art, multiplexing of LEDs involves powering the separate banks of LEDs one at a time in quick succession, rapidly enough that an LED which is "turned on" by the software, appears to be lit continuously. The number of banks into which the LEDs are divided can be varied as desired, but is here chosen to be four in order to provide good apparent brightness of the "on" LEDs.

Figure 11:
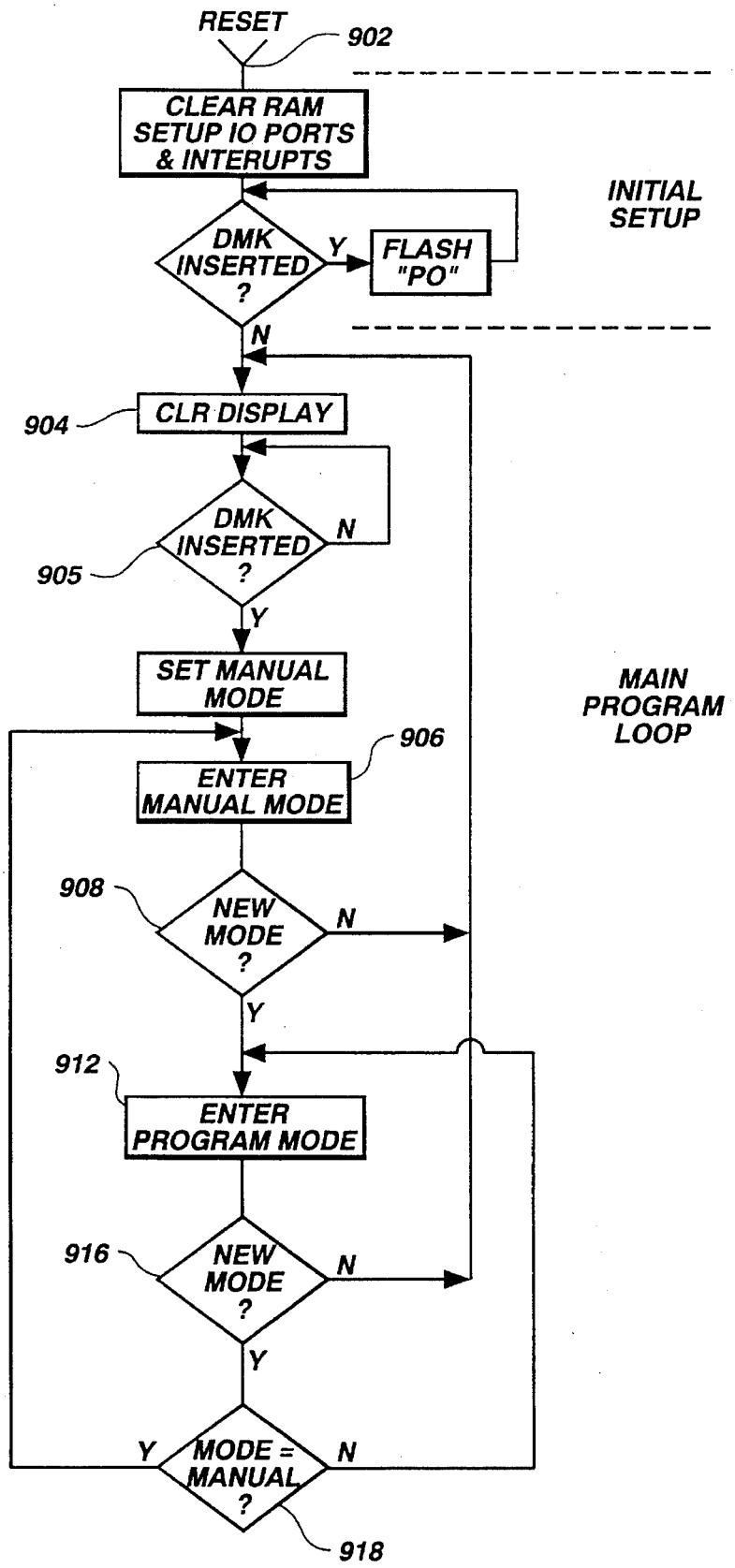
FIGS. 11–15 are logic flow diagrams for operation of the alternate embodiment.

FIGS. 11–15 are logic flow diagrams for computation means 504. The main program loop is shown in FIG. 11. When the computation means is first plugged in to the external power source (initial set-up or reset point 902), it clears RAM 612 and sets up the input/output (I/O) ports and the interrupts. Next, the computation means asks whether the safety switch is activated. If the answer is yes, the display flashes "PO" to instruct the user to pull out the safety switch. If the safety switch is not inserted, the computation means clears the displays (block 904).

After initial setup, the computation means begins by asking if the safety switch is activated by insertion of safety key 181. A user must insert the safety key 181 to operate the console to enter programs or to exercise on the machine. If the safety key 181 has not been inserted, the computation means continues to ask whether the key has been inserted. If the key has been inserted, the computation means sets manual mode and executes the loop for the manual mode (block 906, described in greater detail hereinafter in reference to FIG. 12).

Upon exiting the manual mode (block 910 of FIG. 12), the computation means asks if a new mode has been selected (decision point 908). If no, it returns to step (904), clearing the display. If yes, the computation means executes the loop for the program ((block 912, described in greater detail hereinafter in reference to FIG. 13).

Figure 13:
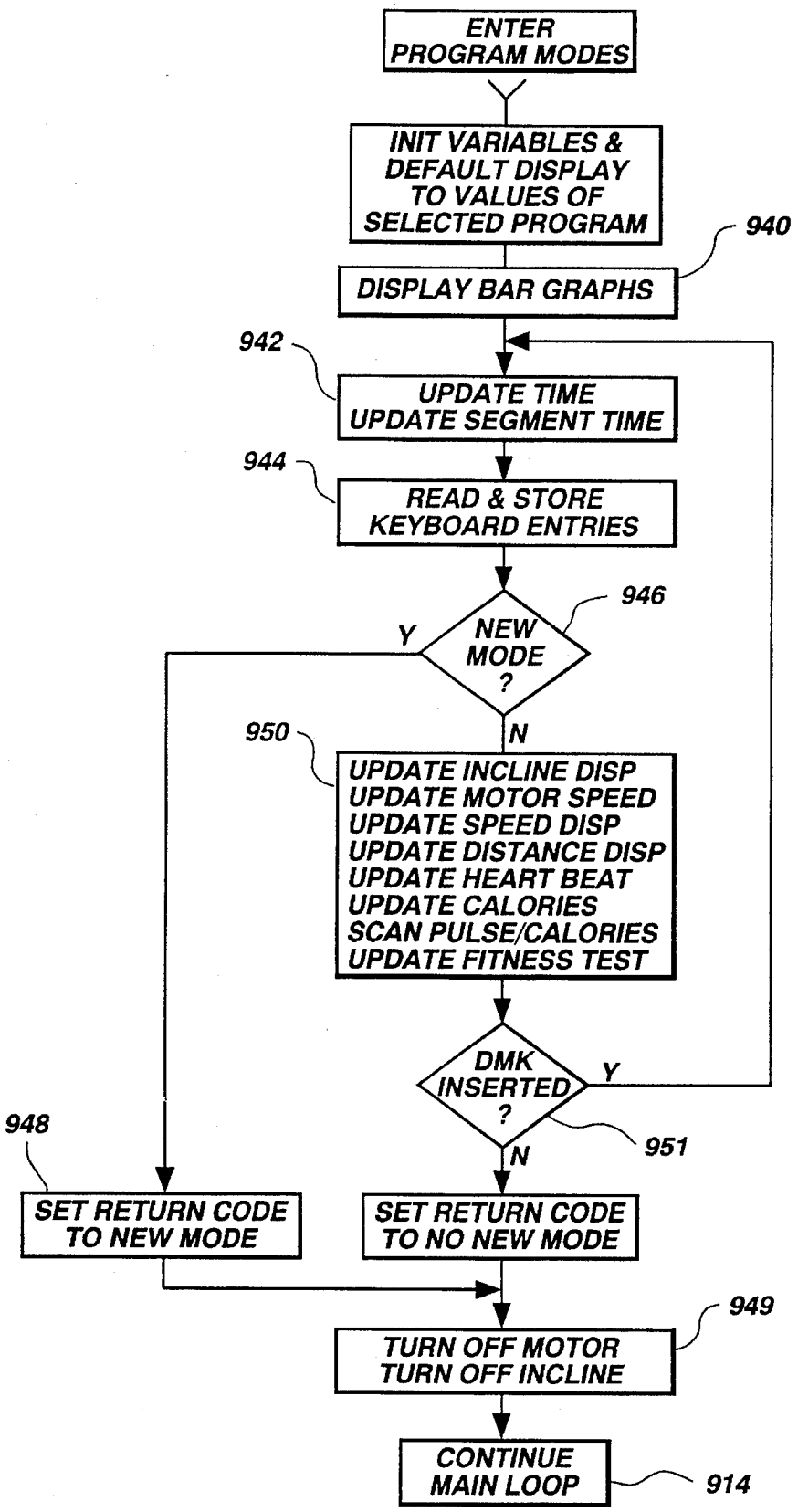

After executing a program and exiting the program mode via block 914 of FIG. 13, the computation means again asks if a new mode has been selected (decision point 916). If no, the computation means returns to block 904 and decision point 905, clearing the display and asking if the deadman key is inserted. If yes, the computation means asks if the mode is manual (decision point 918), in which case it returns to block 906 to execute the manual mode. If the mode selected is not manual, the computation means returns to block 912 to execute the program.

So long as the computation means 504 remains continuously connected to a power source, it continues to function on the main program loop beginning at block 904 of FIG. 11. If the power is interrupted, computation means 504 will go through initial setup from the reset point 902.

Figure 12:
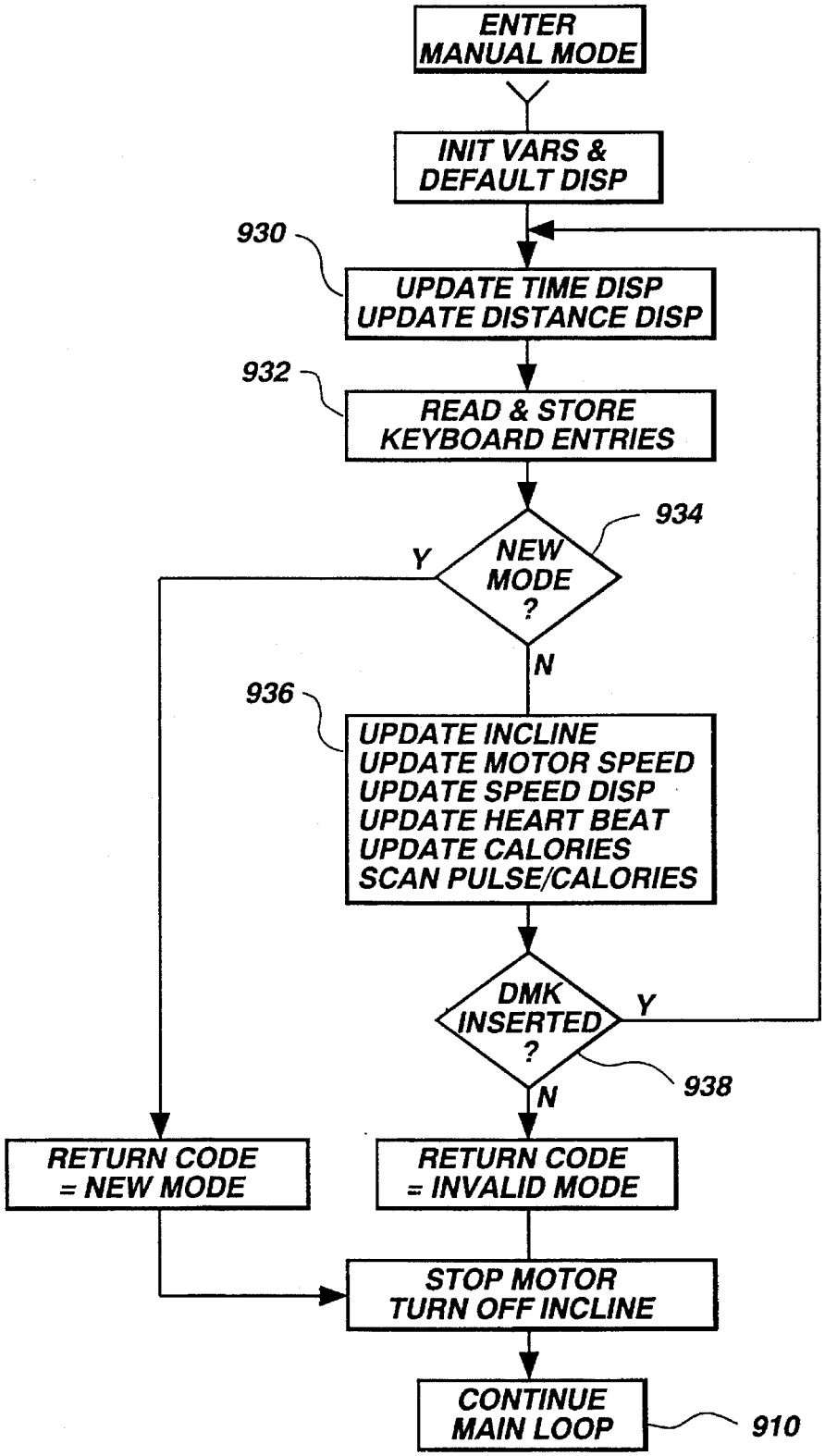

FIG. 12 describes in greater detail the manual mode loop which is entered at block 906 of FIG. 11. Upon entering the manual mode, computation means 504 sets the variables (speed, time, max speed) to initial or default values. Next, it updates the time and distance displays (block 930), and reads and executes the keyboard functions (block 932). After performing these tasks, the computation means asks if a new mode has been selected (decision point 934). If yes, it stops the tread motor, turns off the incline, and exits back to the main program loop of FIG. 11 at block 904. If no, the computation means updates the incline, motor speed and displayed speed values (block 936). Optionally, the computation means also scans and updates the heart rate and the estimated rate and total amount of calories consumed. The computation means next asks whether the safety key 181 is inserted (decision point 938). If yes, it returns to block 930 of the manual mode loop to update the time and distance displays. If no, the computation means stops the tread motor, turns off the incline, and exits the manual mode at block 910.

FIG. 13 describes in greater detail the program mode loop which is entered at block 912 of FIG. 11. First, the computation means sets the variables (speed and/or incline, time, max speed) to the programmed initial or default values. These programmed values may correspond to a preset program or to a user-designed program, depending on which of the program selection keys such as keys 430 of FIG. 4 has been pressed. The computation means then displays the appropriate speed and/or incline values on the graphical array such as arrays 400 and 480 of FIGS. 3 and 4 (block 940). Next, the computation means updates the time and the segment time (block 942) and reads and executes the keyboard functions (block 944).

The computation means then asks whether a new mode is selected (decision point 946). If yes, the computation means sets a return code to "new mode" (block 948), turns off the tread motor and/or incline (block 949), and exits from the program mode loop back to the main program loop at block 904 of FIG. 11. If no new mode is selected at decision point 946, the computation means updates the incline and incline display, the tread motor speed and the speed display, the distance display, and the fitness test (if that is the selected program) (block 950). Optionally at this point, the computation means also scans and updates the heart rate and the calories consumed. More specifically, the user may attach a conventional ear or finger clip to supply actual pulse information to the console via a wire 183 and a connector which is inserted 185 into a corresponding female receptacle in the chassis 42. Internally, any of the disclosed consoles herein may be configured similar to console 40 so that the user may select pulse or heart rate using an appropriate selection key 400A. Also, the user may select a desired heart rate or pulse using the plus 465 key and minus 466 key. The display 486 may thereafter alternate between the target and actual heart or pulse rates.

The computation means then again asks if the safety key 181 is inserted. If yes, it returns to block 942 of the program mode loop to update the time and the segment time. If the safety key 181 is not inserted, the computation means sets a return code to "new mode", turns off the tread motor and/or the incline, and exits through block 914 to the main program loop of FIG. 11 at block 904.

Figure 14:
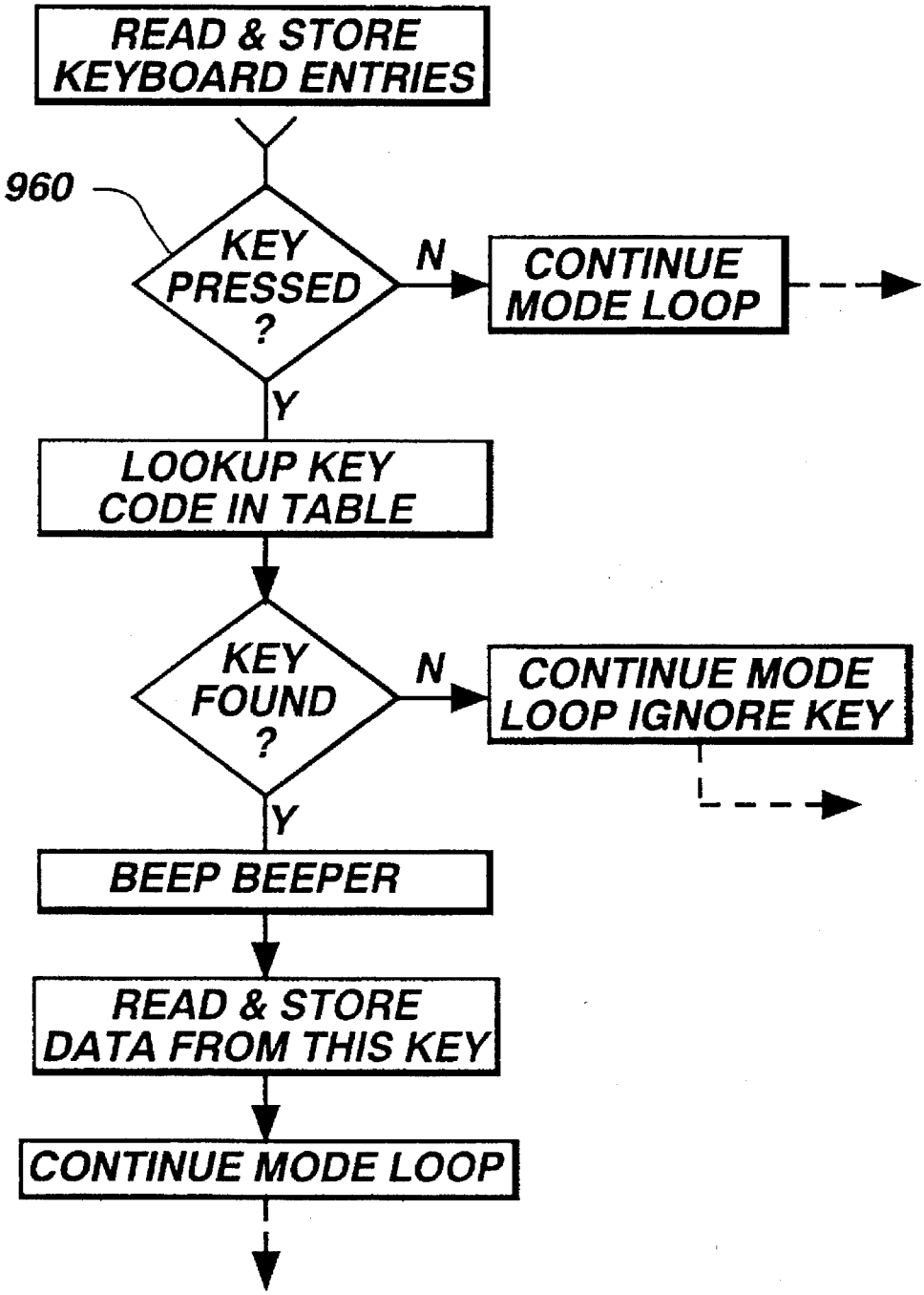

FIG. 14 illustrates in greater detail a subroutine loop represented in FIGS. 12 and 13 respectively by blocks 932 and 944, "read and store keyboard entries". In this subroutine, the computation means first asks if a key has been pressed (decision point 960). If no, the computation means continues in the mode loop it is currently in. If yes, the computation means looks up the key code in a table in the memory. The computation means then asks if the key code was found in the table. If not, the computation means ignores the key and continues in the mode loop. If yes, the computation means causes the console to produce an audible sound such as a beep, and reads and stores the data from the pressed key for later access. The computation means then returns to the mode loop for the selected mode at the point just beyond the command "read and store keyboard entries", e.g., decision points 934 and 946 in FIGS. 12 and 13, respectively.

Figure 15:
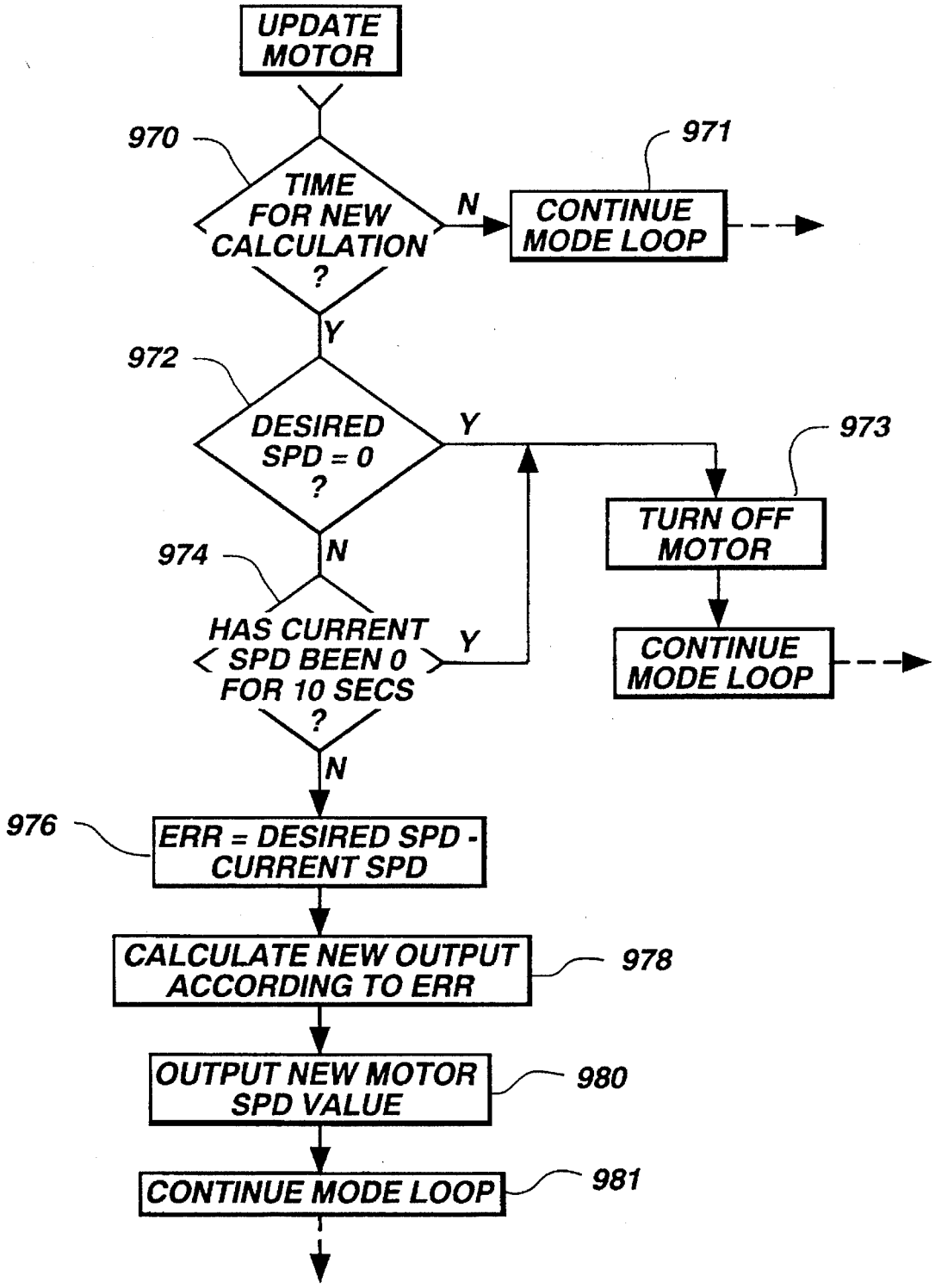

FIG. 15 illustrates the loop represented by "update motor speed" in blocks 936 and 950 of FIGS. 12 and 15, respectively. Computation means 504 of the embodiment of FIGS. 6–10 is capable of providing feedback control of the speed of the tread, by the speed update means described in FIG. 15. Upon being directed to update the motor speed, the computation means asks its counter-timer chip 630 whether it is time for a new calculation (decision point 970). If not, the computation means simply continues (block 971) in the mode loop corresponding to the selected mode, which brings it to decision point 938 or 951 in manual mode or program mode, respectively. If yes, the computation means asks if the desired speed is zero (decision point 972). If yes, the computation means turns off the motor (block 973) and exits. If no, the computation means then asks whether the speed has been zero for 10 seconds (decision point 974). If yes, the computation means triggers the display to display an error message in field 439, turns off the motor (block 973) and exits. If no, the computation means computes the error between the set speed and the actual speed (block 976). The computation means then calculates and sends a new output to the motor to bring the speed to the set speed (blocks 978, 980 respectively). The computation means then exits this loop to continue (block 981) in the current mode loop from decision point 938 or 951 in manual mode or program mode, respectively.

FIG. 16 depicts a fitness program which may be inserted into the computation means 504 of an embodiment for use in a treadmill wherein both incline and speed may be varied. The fitness test has a series of stages in which the speed and/or the inclination are steadily increased. For example, in the first stage, the speed may be the lowest starting speed such as 1 mile per hour, and the incline may be 1%, for a time of 1 minute and 25 seconds. In the second stage, the speed is increased to 2 miles per hour, and the incline to 2.5%, for a 1 minute period. Subsequent stages provide further increases in speed and/or incline, up to the maximum available treadmill speed/maximum incline in the final stage. The total time and the times for individual stages of the fitness test may vary according to the selected maximum speed of the treadmill. A user performing the fitness test exercises until (s)he reaches the point of being unable to continue, at which point the user presses stop button 434. During the performance of the test, the computation means displays in field 460 the number corresponding to the portion of the fitness test which is complete at that time. When the user presses the stop button 434, the computation means turns off the motor and continues to display the number corresponding to the segment of the fitness test which was being performed at the time the "stop" key was pressed. This number is termed a fitness number, and is based upon the fraction of total time of the fitness test which the user has completed.

The fitness numbers may be correlated with an empirically-derived table containing data for an average individual of a particular weight, age and sex. This table may be obtained by ascertaining the percentage of the fitness test completed for individuals of a given weight, age and sex having varying actual fitness levels. Preferably, the actual fitness levels of the tested individuals have been assessed by other indicia such as rate of oxygen consumption during exercise. Such a table could be provided in a printed form for the user, or programmed into a computation means which also had the capacity to receive and store age, sex and weight information.

The computation means may also be operable to perform a "random" preset program in which the relative difficulty levels for the respective time segments are randomly selected and are different each time the key designating the "random" program is pressed. For this purpose, computation means 504 includes a random-number generator which is accessed to produce a different sequence of difficulty levels each time the "random" program key is pressed. Other preset programs, such as one simulating a hill which is "climbed" and then descended by altering the incline, are also possible.

It may be noted that the specific details of each circuit illustrated and each function are readily known by reference to FIGS. 2 and 9–10 which show circuitry of working examples, and reference to the logic flow diagrams FIGS. 5 and 11–15. The specific programming structure of the computation means 102 and computation means 504 will therefore be readily known to those skilled in the art.

What is claimed is:

1. An exercise machine having a frame;

at least one movable element mechanically associated with the frame and configured to enable a user to perform exercises;

difficulty adjustment means operably adapted to the movable element for adjusting the difficulty of the exercises; and a control console comprising:

a chassis mounted to said frame;

control means disposed within said chassis, communicatively connected to said difficulty adjustment means, and configured for controlling said difficulty adjustment means in accordance with a user-designed program comprising a sequence of time segments each having a corresponding difficulty level specified by a user; and input display means disposed for viewing on said chassis, and including a plurality of arrays of electrical indicators, each said array representing one of said time segments, and said indicators being arranged within each said array to visually represent a series of difficulty levels ranging between a low and a high difficulty, and bi-directional selector means operably connected to said control means and said indicators for operation by a user to select and display said user-selected difficulty level for each of said time segments, said input display means further being operable to display said specified difficulty level in approximate simultaneous response to operation of said selector means by the user.

2. The exercise machine of claim 1, wherein said indicators are selected from the group consisting of: light-emitting diodes and liquid crystal displays.

3. The exercise machine of claim 2, wherein said control means comprises:

memory means connected to said input means and said display means for operative storage of said user-designed program, computation means connected to said memory means for computing difficulty control signals in accordance with said user-designed program, and output means connected to receive said difficulty control signals from said computation means and connectable to the difficulty adjustment means for supplying machine control signals thereto, said machine control signals being reflective of said difficulty control signals.

4. The exercise machine of claim 1 wherein said arrays are columns of said indicators, each column representing one of said time segments, and illumination of a particular indicator within one of said columns represents selection of a particular corresponding difficulty level.

5. The exercise machine of claim 4, wherein said input display means further includes progress display means associated with said columns for providing a distinguishing identifier to identify an individual said column corresponding to a time segment currently in progress.

6. The exercise machine of claim 1 further including a second adjustment means associated with said movable element for adjusting a second difficulty parameter of said exercises.

7. The exercise machine of claim 6 wherein said user-designed program further comprises a sequence of relative levels of said second difficulty parameter, and said control means is further connected to said second adjustment means and configured to control said second adjustment means in accordance with said user-designed program.

8. The exercise machine of claim 7 wherein said display means further includes a second series of columns arranged to display said sequence of levels of said second difficulty parameter in accordance with said user-designed program.

9. The exercise machine of claim 1, wherein said frame is a bicycle frame, said movable element is a pedal, and further including a wheel rotatably attached to said bicycle frame for rotation by operation of said pedal, and wherein said difficulty adjustment means adjusts the resistance to rotation of said wheel.

10. The exercise machine of claim 1, wherein said frame is a treadmill frame, said movable element is a moving tread, and wherein said difficulty adjustment means adjusts the speed of movement of said moving tread.

11. The exercise machine of claim 1, wherein said frame is a treadmill frame disposed on a support surface and including a platform inclined at an angle relative to said support surface, said movable element is a moving tread aligned along said platform, and wherein said difficulty adjustment means adjusts said angle of inclination of said platform.

12. The exercise machine of claim 11, wherein said control means is further connectable and configured to control a speed adjustment means which adjusts the speed of said moving tread.

13. A control console for an exercise machine of the kind having a frame, at least one movable element adapted to the frame and configured to enable a user to perform exercises, and difficulty adjustment means operably adapted to the movable element for adjusting the difficulty of the exercises, said control console comprising:

a chassis mountable to the frame;

control means disposed within said chassis and connectable to the difficulty adjustment means for controlling the difficulty adjustment means to execute a user-designed exercise program comprising a sequence of time segments each having a user-specified difficulty level; and input display means disposed for viewing on said chassis, and including a plurality of arrays of electrical indicators, each said array representing one of said time segments, and said indicators being arranged within each said array to visually represent a series of difficulty levels ranging between a low and a high difficulty, and bi-directional selector means operably connected to said control means and said indicators for operation by a user to select and display said user-selected difficulty level for each of said time segments, said input display means further being operable to display said specified difficulty level in approximate simultaneous response to operation of said selector means by the user.

14. The control console of claim 13, wherein said control means includes memory means connected to said input display means for operative storage of said user-designed program, computation means connected to said memory means for computing difficulty control signals in accordance with said user-designed program, and output means connected to receive said difficulty control signals from said computation means and connectable to the difficulty adjustment means for supplying machine control signals thereto, said machine control signals being reflective of said difficulty control signals.

15. The control console of claim 13, wherein said indicators are selected from the group consisting of: LEDs and LCDs.

16. The control console of claim 13, wherein said control means is further operably configured to store said user-designed program for subsequent recall, and said input display means further includes program selection means operably connected and configured for a user to recall said user-designed program, cause it to be displayed by said plurality of arrays of indicators, and initiate its execution by said control means.

17. The control console of claim 16, wherein said control means further includes a permanent memory unit storing at least one preset program comprising a series of time segments having a corresponding preset difficulty levels, said control means is further configured to control the difficulty adjustment means in accordance with said preset program, and said program selection means is further operable to select said preset program for display and execution.

18. The control console of claim 13, wherein said control means is further operable to compute and supply progress signals to said input display means, and said input display means further includes progress display means associated with said arrays for providing a visible distinguishing identifier proximate an individual said array corresponding to a time segment currently in progress.

19. The control console of claim 13, wherein said control means is configured to control a difficulty adjustment means which adjusts the resistance to pedaling of a bicycle.

20. The control console of claim 13, wherein said control means is configured to control a difficulty adjustment means which adjusts the speed of a treadmill.

21. The control console of claim 13, wherein said control means is configured to control a difficulty adjustment means which adjusts the inclination of a treadmill.

22. An exercise machine having a frame;

at least one movable element mechanically associated with the frame and configured to enable a user to perform exercises;

difficulty adjustment means operably adapted to the movable element for adjusting the difficulty of the exercises;

a second adjustment means associated with said movable element for adjusting a second difficulty parameter of said exercises; and a control console comprising:

a chassis mounted to said frame;

control means disposed within said chassis, communicatively connected to said difficulty adjustment means, and configured for controlling said difficulty adjustment means in accordance with a user-designed program comprising a sequence of time segments each having a corresponding difficulty level specified by a user and further comprising a sequence of relative levels of said second difficulty parameter, said control means further connected to said second adjustment means and configured to control said second adjustment means in accordance with said user-designed program; and input display means disposed for viewing on said chassis, and including a plurality of arrays of electrical indicators, each said array representing one of said time segments, and said indicators being arranged within each said array to visually represent a series of difficulty levels ranging between a low and a high difficulty, and bi-directional selector means operably connected to said control means and said indicators for operation by a user to select and display said user-selected difficulty level for each of said time segments, wherein said display means further includes a second series of columns arranged to display said sequence of levels of said second difficulty parameter in accordance with said user-designed program.

23. An exercise machine having a treadmill frame disposed on a support surface and including a platform inclined at an angle relative to said support surface;

at least one movable element comprising a moving tread aligned along said platform mechanically associated with the treadmill frame and configured to enable a user to perform exercises;

difficulty adjustment means operably adapted to the movable element for adjusting the difficulty of the exercises by adjusting the angle of inclination of said platform; and a control console comprising:

a chassis mounted to said treadmill frame;

control means disposed within said chassis and further connectable and configured to control a speed adjustment means which adjusts the speed of said moving tread, communicatively connected to said difficulty adjustment means, and configured for controlling said difficulty adjustment means in accordance with a user-designed program comprising a sequence of time segments each having a corresponding difficulty level specified by a user; and input display means disposed for viewing on said chassis, and including a plurality of arrays of electrical indicators, each said array representing one of said time segments, and said indicators being arranged within each said array to visually represent a series of difficulty levels ranging between a low and a high difficulty, and bi-directional selector means operably connected to said control means and said indicators for operation by a user to select and display said user-selected difficulty level for each of said time segments, wherein said user-designed program further includes a sequence of speed levels respectively selectable by the user for each of said time segments.

24. The exercise machine of claim 23 wherein said plurality of arrays is divided into two sets, one representing a sequence of inclination values and one representing said sequence of speed levels.

25. A control console for an exercise machine of the kind having a frame, at least one movable element adapted to the frame and configured to enable a user to perform exercises, and difficulty adjustment means operably adapted to the movable element for adjusting the difficulty of the exercises, said control console comprising:

a chassis mountable to the frame;

control means disposed within said chassis and connectable to the difficulty adjustment means for controlling the difficulty adjustment means to execute a userdesigned exercise program comprising a sequence of time segments each having a user-specified difficulty level; and input display means disposed for viewing on said chassis, and including a plurality of arrays of electrical indicators, each said array representing one of said time segments, and said indicators being arranged within each said array to visually represent a series of difficulty levels ranging between a low and a high difficulty, and bi-directional selector means operably connected to said control means and said indicators for operation by a user to select and display said user-selected difficulty level for each of said time segments, wherein said control means is further operable to compute and supply progress signals to said input display means, and said input display means further includes progress display means associated with said arrays for providing a visible distinguishing identifier proximate an individual said array corresponding to a time segment currently in progress.

* * * * *

UNITED STATES PATENT AND TRADEMARK OFFICE

CERTIFICATE OF CORRECTION

PATENT NO. : 5,512,025

DATED : Apr. 30, 1996

INVENTOR(S) : Dalebout et al.

It is certified that error appears in the above-identified patent and that said Letters Patent is hereby corrected as shown below:

Col. 5, line 44, after "a motor" change "38" to --36--

Col. 12, line 19, after "respectively." change "Outputs" to --Inputs--

Col. 13, line 14, after "is a" change "6116" to --616--

Col. 15, line 24, change "465" and "466" to --465-- and --466--

Col. 19, line 17, after "having" delete "a"

Signed and Sealed this

Eighteenth Day of April, 2000

*Attest:*

Q. TODD DICKINSON

*Attesting Officer*

*Director of Patents and Trademarks*